US011260262B2

(12) United States Patent
Oltorik et al.

(10) Patent No.: US 11,260,262 B2
(45) Date of Patent: Mar. 1, 2022

(54) PORTABLE RESISTANCE WORKOUT APPARATUSES AND SYSTEMS

(71) Applicant: Rhino Boss LLC, Cincinnati, OH (US)

(72) Inventors: Dennis R. Oltorik, Blue Ash, OH (US); Dennis R. Oltorik, Jr., Cincinnati, OH (US)

( * ) Notice: Subject to any disclaimer, the term of this patent is extended or adjusted under 35 U.S.C. 154(b) by 226 days.

(21) Appl. No.: 16/443,582

(22) Filed: Jun. 17, 2019

(65) Prior Publication Data

US 2020/0023229 A1 Jan. 23, 2020

Related U.S. Application Data

(60) Provisional application No. 62/771,386, filed on Nov. 26, 2018, provisional application No. 62/685,767, filed on Jun. 15, 2018.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 24/00*** | (2006.01) |

(52) U.S. Cl.

CPC ..... *A63B 21/4033* (2015.10); *A63B 21/0442* (2013.01); *A63B 21/0552* (2013.01); *A63B 24/0062* (2013.01); *A63B 2210/50* (2013.01); *A63B 2220/51* (2013.01); *A63B 2225/52* (2013.01)

(58) Field of Classification Search

CPC ..... A63B 21/4033; A63B 21/0442; A63B 21/0552; A63B 24/0062; A63B 2210/50; A63B 2220/51; A63B 2225/52; A63B 2024/0068; A63B 2230/75; A63B 2220/833; A63B 2220/17; A63B 2225/50; A63B 2071/065; A63B 71/0036; A63B 2225/20; A63B 2225/10; A63B 71/0622; A63B 2225/74; A63B 1/00

See application file for complete search history.

(56) References Cited

U.S. PATENT DOCUMENTS

| | | | |
|---|---|---|---|
| 1,623,670 | A | 4/1927 | Frankenfeld |
| 1,623,671 | A | 4/1927 | Frankenfeld |
| 2,829,891 | A | 4/1958 | Ludwig |
| 3,633,907 | A | 1/1972 | Cane et al. |
| 3,636,946 | A | 1/1972 | Hardy |

(Continued)

FOREIGN PATENT DOCUMENTS

WO 2017179997 A1 10/2017

OTHER PUBLICATIONS

International Search Report and the Written Opinion of the International Searching Authority issued in International Application No. PCT/US2019/037546, dated Sep. 4, 2019, 11 pages in its entirity.

*Primary Examiner* — Sundhara M Ganesan
(74) *Attorney, Agent, or Firm* — Ulmer & Berne LLP

(57) ABSTRACT

A portable strength training apparatus, system and method. The apparatus can include a platform base having a top surface, a bottom surface, and a plurality of base attachment mechanisms. One or more of the plurality of base attachment mechanisms can be removably coupled to a resistance band. A force sensor can be coupled to the resistance band, the force sensor comprising a force transducer that can include electronic circuitry to track, record, and analyze resistance forces applied to the resistance band.

14 Claims, 45 Drawing Sheets

(56) References Cited

U.S. PATENT DOCUMENTS 4,198,044 A 4/1980 Holappa
4,371,162 A 2/1983 Hartzell
4,863,163 A 9/1989 Wehrell
4,968,028 A 11/1990 Wehrell
4,982,958 A 1/1991 Ullman
5,292,297 A 3/1994 Hsu
5,538,486 A * 7/1996 France ..... A63B 21/169 482/8
5,551,934 A 9/1996 Binette
5,584,783 A * 12/1996 Hagg ..... A63B 22/0012 482/123
5,645,510 A 7/1997 Wilkinson
6,299,569 B1 10/2001 Rich
6,500,104 B1 12/2002 Rich
6,558,301 B1 5/2003 Jackson
6,872,175 B2 3/2005 Lin
7,431,681 B1 10/2008 St. Cyr
D590,457 S 4/2009 Mishan
7,608,025 B1 10/2009 Best
7,648,449 B1 1/2010 Detert
7,739,775 B2 6/2010 Shimanski
7,951,054 B2 5/2011 Snow et al.
7,967,736 B2 6/2011 D'Silva et al.
8,088,050 B2 1/2012 Aucamp
D700,792 S 3/2014 Melton
8,684,894 B2 4/2014 Flynn
8,721,507 B2 5/2014 Blancher
8,936,539 B2 1/2015 Richard et al.
9,061,172 B1 6/2015 Carrier
9,199,110 B2 12/2015 Jones
9,259,606 B2 2/2016 Wolan
RE46,874 E 5/2018 D'Silva et al.
10,220,236 B2 3/2019 Oltorik, Jr.
2003/0083178 A1 5/2003 Gilman
2006/0019806 A1 1/2006 Mikulski
2006/0040808 A1* 2/2006 Riazi ..... A63B 71/023 482/141
2006/0199706 A1 9/2006 Wehrell
2007/0087920 A1 4/2007 Dachraoui et al.
2008/0119763 A1* 5/2008 Wiener ..... A63B 21/169 600/587
2008/0199763 A1* 8/2008 Ito ..... H01M 50/147 429/54
2008/0203776 A1* 8/2008 Mongelluzzo ..... A63B 21/4035 297/118
2009/0305854 A1 12/2009 Brown, Jr.
2010/0016132 A1 1/2010 Flynn
2010/0227744 A1* 9/2010 Dang ..... A63B 21/0023 482/91
2010/0323857 A1 12/2010 D'Silva et al.
2011/0021329 A1 1/2011 Dunne
2011/0218077 A1 9/2011 Fernandez et al.
2011/0251033 A1 10/2011 Blancher
2012/0115692 A1 5/2012 Bussen et al.
2012/0244997 A1 9/2012 Thompson
2013/0244835 A1 9/2013 Thompson
2014/0162858 A1 1/2014 Dalebout
2014/0066262 A1 3/2014 Kennedy
2014/0113773 A1 4/2014 Marghella
2014/0148317 A1* 5/2014 Mutch ..... A63B 21/02 482/129
2014/0155232 A1 6/2014 Wolan
2014/0287894 A1 9/2014 Austin
2014/0323271 A1* 10/2014 Hinds ..... A63B 21/0555 482/8
2015/0018178 A1 1/2015 Carbone et al.
2015/0024914 A1 1/2015 Lagree
2015/0157896 A1* 6/2015 Soerensen ..... A63B 21/0552 482/8
2015/0297128 A1* 10/2015 Shield ..... A63B 21/4029 600/595
2016/0121194 A1* 5/2016 Chuang ..... A63B 21/0442 434/254
2016/0144217 A1 5/2016 Oltorik, Jr.
2016/0184634 A1* 6/2016 Yanev ..... A63B 21/023 482/8
2016/0199697 A1 7/2016 Orfield
2016/0220863 A1 8/2016 Braier et al.
2017/0157486 A1* 6/2017 Chuang ..... A63B 21/4009
2017/0312582 A1 11/2017 Root, Jr.
2017/0333742 A1* 11/2017 Reese ..... A63B 21/4043
2017/0368400 A1* 12/2017 Chapman ..... A63B 23/0405
2018/0028854 A1* 2/2018 Carter ..... A63B 21/16
2018/0093121 A1 4/2018 Matsuura et al.
2018/0154213 A1* 6/2018 Chen ..... A61B 5/22
2018/0290002 A1* 10/2018 Colangelo ..... A63B 21/00043
2019/0126097 A1* 5/2019 Thomson ..... A63B 21/0557
2020/0023229 A1 1/2020 Oltorik et al.

* cited by examiner

PORTABLE RESISTANCE WORKOUT APPARATUSES AND SYSTEMS

CROSS-REFERENCE TO RELATED APPLICATIONS

The present application claims priority to U.S. Provisional Patent Ser. No. 62/685,767, filed Jun. 15, 2018 and to U.S. Provisional Patent Ser. No. 62/771,386, filed Nov. 26, 2018, and hereby incorporates the applications herein by reference in their entirety.

FIELD OF THE TECHNOLOGY

The present disclosure contemplates a portable apparatus, system and method for conducting strength training exercises using resistance bands.

BACKGROUND

Previous portable apparatuses and systems used for resistance workouts do not permit the user to track, record, and analyze data related to a workout.

Accordingly, there is a continuing unmet need for a portable apparatus and system for resistance workouts that permit the user to track, record, and analyze data related to a workout.

SUMMARY OF THE DISCLOSURE

A portable strength training apparatus, system and method is disclosed. The apparatus can include a platform base having a top surface, a bottom surface, and a plurality of base attachment mechanisms. One or more of the plurality of base attachment mechanisms can be removably coupled to a resistance band. A force sensor can be coupled to the resistance band, the force sensor comprising a force transducer that can include electronic circuitry to track, record, and analyze resistance forces applied to the resistance band.

BRIEF DESCRIPTION OF THE DRAWINGS

The foregoing and other features of the present disclosure will become more fully apparent from the following description, taken in conjunction with the accompanying drawings. Understanding that these drawings depict only several embodiments in accordance with the disclosure and are therefore not to be considered limiting of its scope, the disclosure will be described with additional specificity and detail through use of the accompanying drawings.

DETAILED DESCRIPTION

Figure 1:
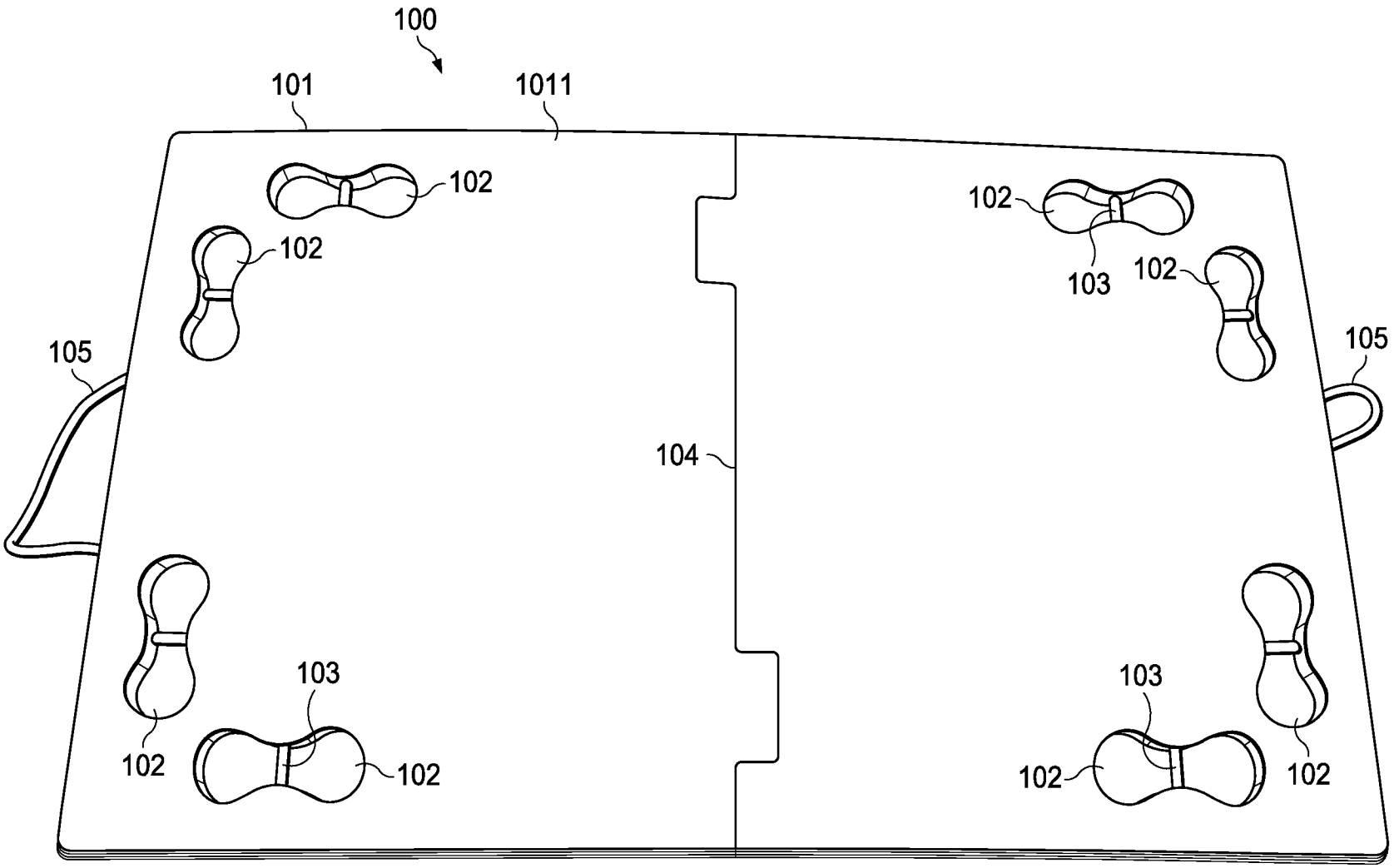
FIG. 1 is a top view of an example portable strength training apparatus.

In the following detailed description, reference is made to the accompanying drawings, which form a part hereof. In the drawings, similar symbols typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Figure 2:
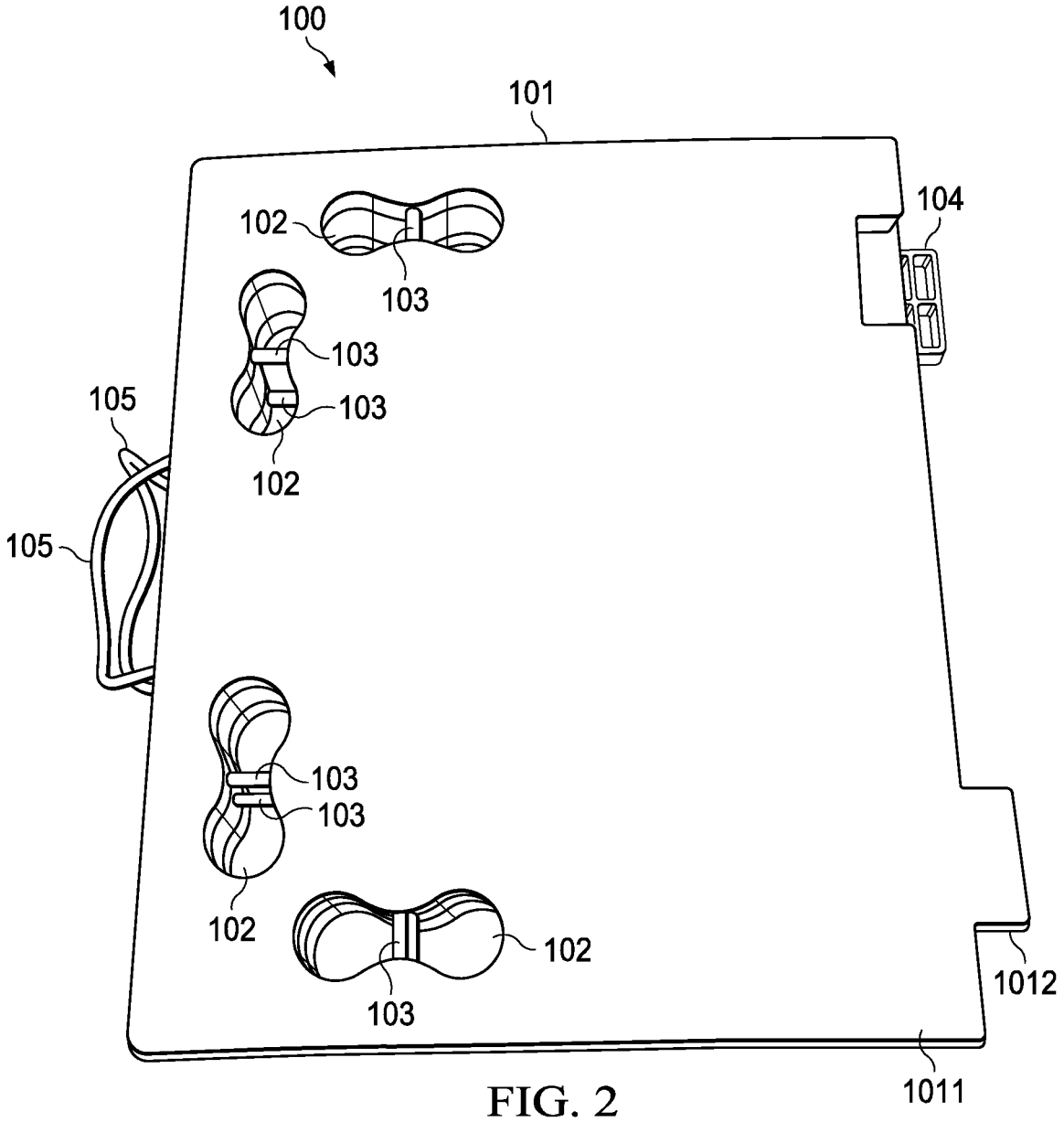
FIG. 2 is a top view of an example portable strength training apparatus where the platform base is folded along the hinge.

FIG. 1 and FIG. 2 depict one embodiment of a portable strength training apparatus 100 having a platform base 101 having a top surface 1011, a bottom surface 1012, and a plurality of base attachment mechanisms 103, wherein one or more of the plurality of base attachment mechanisms 103 may be removably coupled with a resistance band (described below).

As shown in FIGS. 1 and 2, the portable strength training apparatus 100 may have a hinge 104. The hinge 104, as depicted in FIG. 2, may allow the platform base 101 to fold over on to itself for easier transportation. The portable strength training apparatus 100 may have a handle 105, such as hand holds, again for easier transportation. The handle 105 may be rope, plastic, metal, or other material capable of sustaining the weight of the portable strength training apparatus 100 during transportation. The handle 105 may be attached to the platform base during molding process, through welding, using an adhesive, or using another method capable of sustaining the weight of the portable strength training apparatus 100 during transportation.

In FIG. 1 the base attachment mechanisms 103 are situated within generally hourglass-shaped base voids 102 that pass through the platform base 101. The base attachment mechanisms 103 can extend across the narrow portion of the hourglass shape and may be metal, plastic, or another material capable of withstanding the pressure of the resistance bands. The base voids 102 may be placed anywhere throughout the platform base 101 and there may be any number of base voids 102 and corresponding base attachment mechanism 103.

FIGS. 3-7 show another embodiment of a portable strength training apparatus 100 having a platform base 101 having a top surface 1011, a bottom surface 1012, and a plurality of base attachment mechanisms 103, wherein one or more of the plurality of base attachment mechanisms 103 may be removably coupled with a resistance band (described below).

Figure 3:
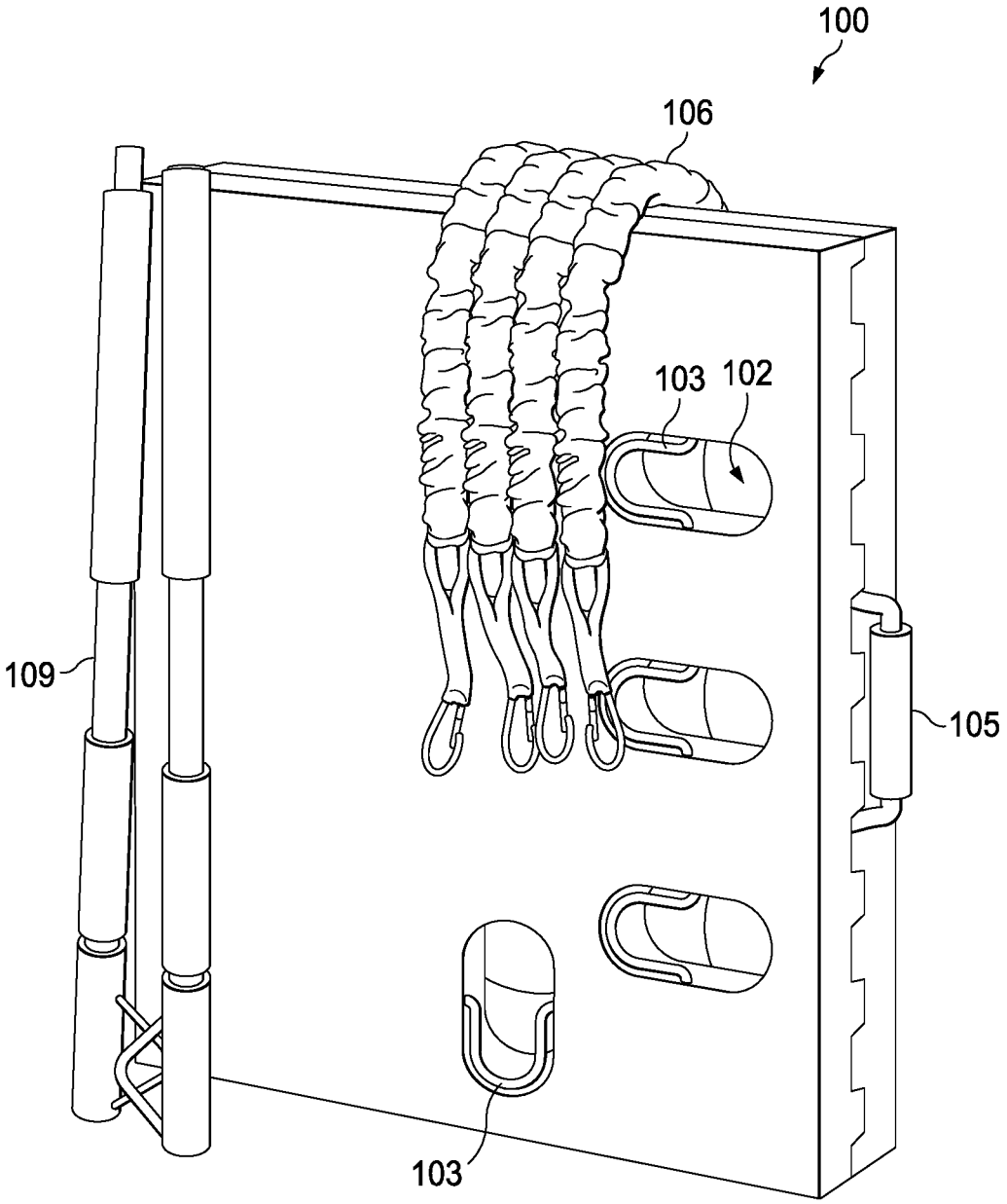
FIG. 3 is a perspective view of an example portable strength training apparatus.

FIG. 3 shows a portable strength training apparatus 100 in a folded state, with portions of the apparatus and system shown, such as handle 105, resistance bands 106, and human interface mechanism 109, i.e., workout bar 1091, all of which are discussed in more detail below. Base attachment mechanisms 103 can be situated within generally oval-shaped base voids 102 that pass through the platform base 101. The base attachment mechanisms 103 can extend across the narrow portion of the oval shape and can be attached pivotally, and may be metal, plastic, or another material capable of withstanding the pressure of the resistance bands 106. The base voids 102 may be placed anywhere throughout the platform base 101 and there may be any number of base voids 102 and corresponding base attachment mechanism 103.

Figure 4:
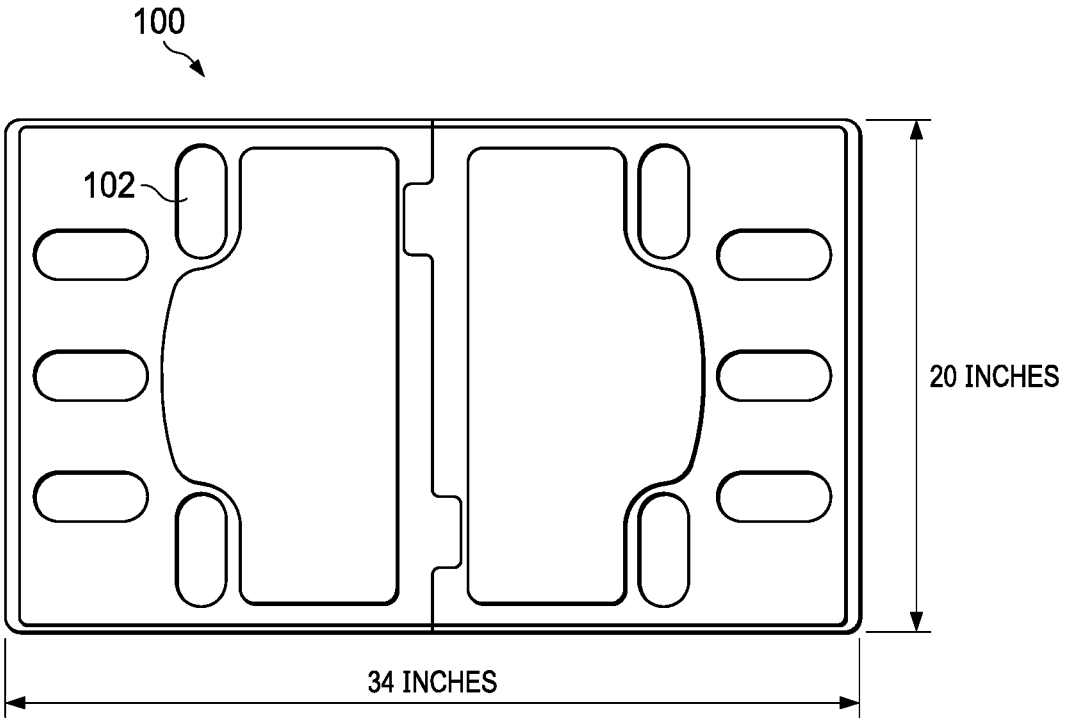
FIG. 4 is a schematic representation top view of an example portable strength training apparatus.

A representative placement and relative spacing of base voids 102 on platform base 101 is shown schematically in FIG. 4. As shown, platform base 101 can be from about 24 to about 48 inches long, and can be about 34 inches long. The platform base 101 can be from about 10 to about 30 inches wide and can be about 20 inches wide. Base voids 102 can be spaced in a pattern in which a base void 102 on one side is paired in line with another base void 102 on an opposite side. Such pairing of base voids, and the accompanying attachment mechanisms 103, permits symmetric pairing of resistance bands for more effective workouts.

Figure 5:
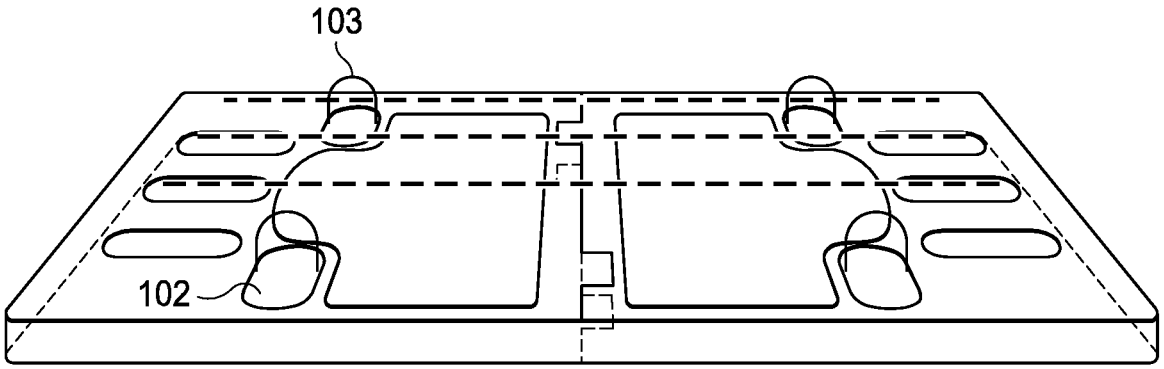
FIG. 5 is a schematic representation perspective view of an example portable strength training apparatus.
Figure 6:
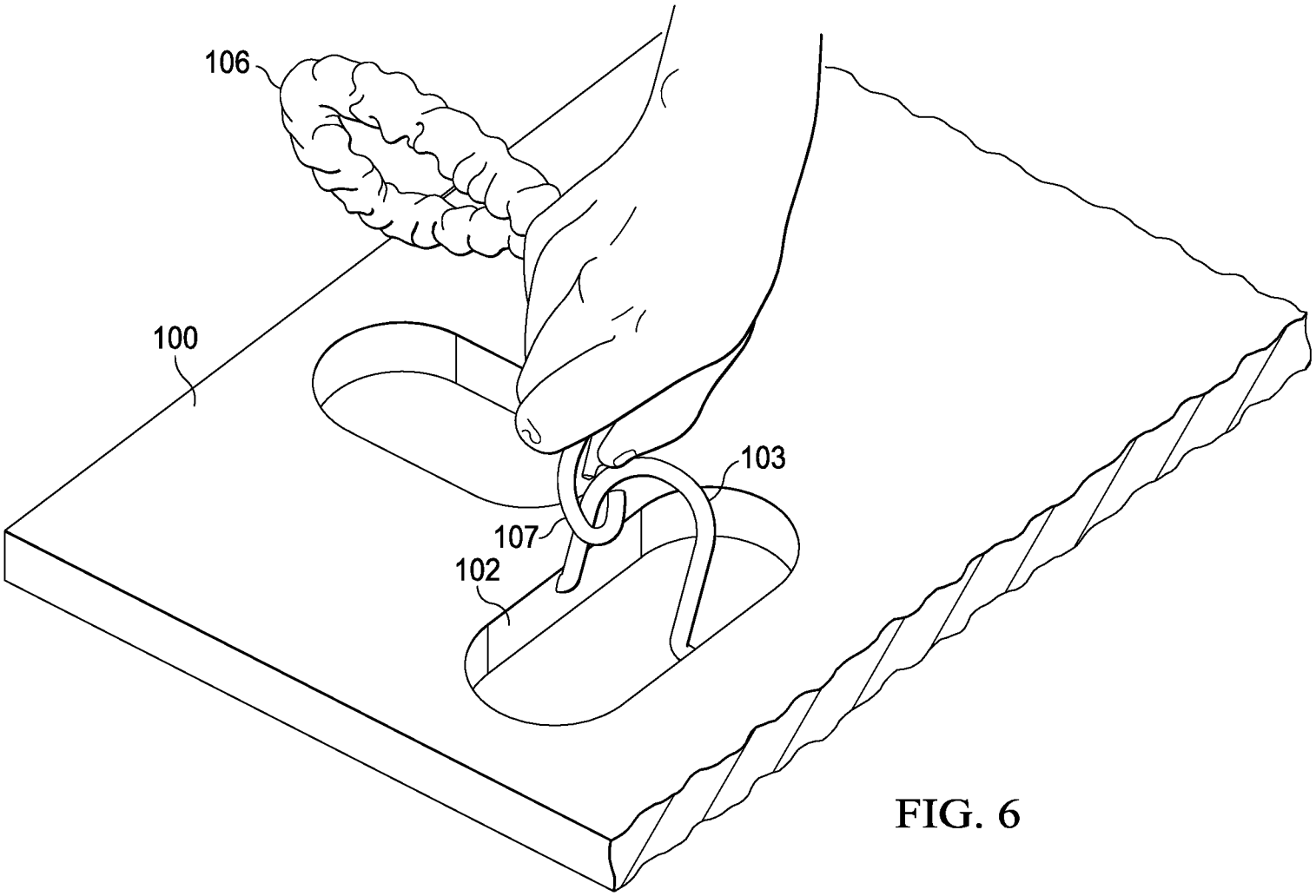
FIG. 6 is a perspective view of a portion of an example portable strength training system.

As shown in the schematic representation of FIG. 5, the pivotally attached attachment mechanisms 103 of the embodiment shown in FIGS. 3-5 can be generally an inverted U-shape with pins for pivotal attachment. Such an arrangement permits the attachment mechanisms 103 to be folded down for storage or non-use and pivoted up for connection to a resistance band. As shown in FIG. 6, a resistance band 106 can be attached to an attachment mechanism 103 by a coupling mechanism 107, such as a clip, carabiner, or the like. Thus, in an embodiment, attachment mechanisms 103 can be pivoted from an in-use position in which a connection point to a coupling mechanism 107 is disposed above the top surface 1011, to a storage (or non-use) position in which the attachment mechanism 103 lies below the top surface 1011. In an embodiment, the attachment mechanism 103 storage position can be between the top surface 1011 and the bottom surface 1012. In use, resistance bands can be threaded, or woven, through one or more attachment mechanisms to effectively shorten a resistance band. Shortening a resistance band can increase the effective workout difficulty for the user.

Figure 7:
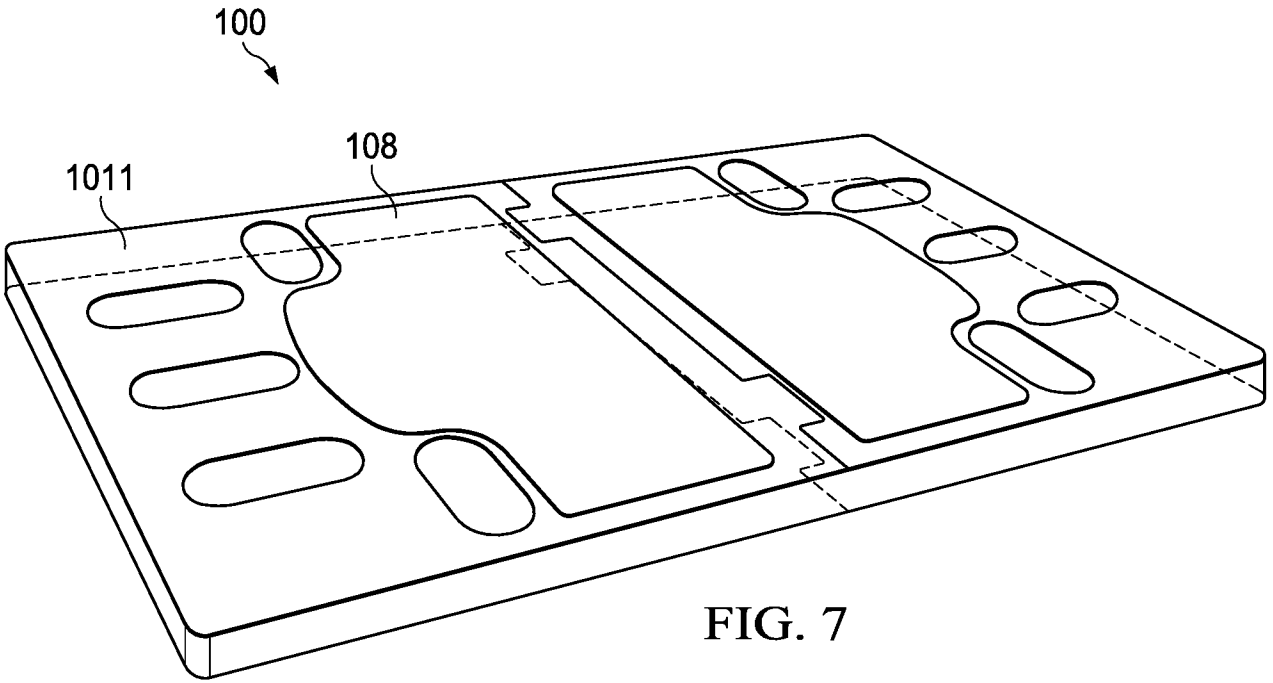
FIG. 7 is a schematic representation perspective view of an example portable strength training apparatus.

The schematic representation of FIG. 7 shows a top surface 1011 of platform base 101 in an embodiment having disposed thereon a slip-resistant surface 108, which can be a roughened portion of the base 101 material, or a separate material adhered to the platform base 101. The slip-resistant surface 108 aids in providing a secure, relatively non-slipping area for hands or feet during a workout. The slip-resistant surface 108 can be any size or shape as desired for appearance and effective slip-resistance.

FIGS. 8-12 show another embodiment of a portable strength training apparatus 100 having a platform base 101 having a top surface 1011, a bottom surface 1012, and a plurality of base attachment mechanisms 103, wherein one or more of the plurality of base attachment mechanisms 103 may be removably coupled with a resistance band (described below).

Figure 8:
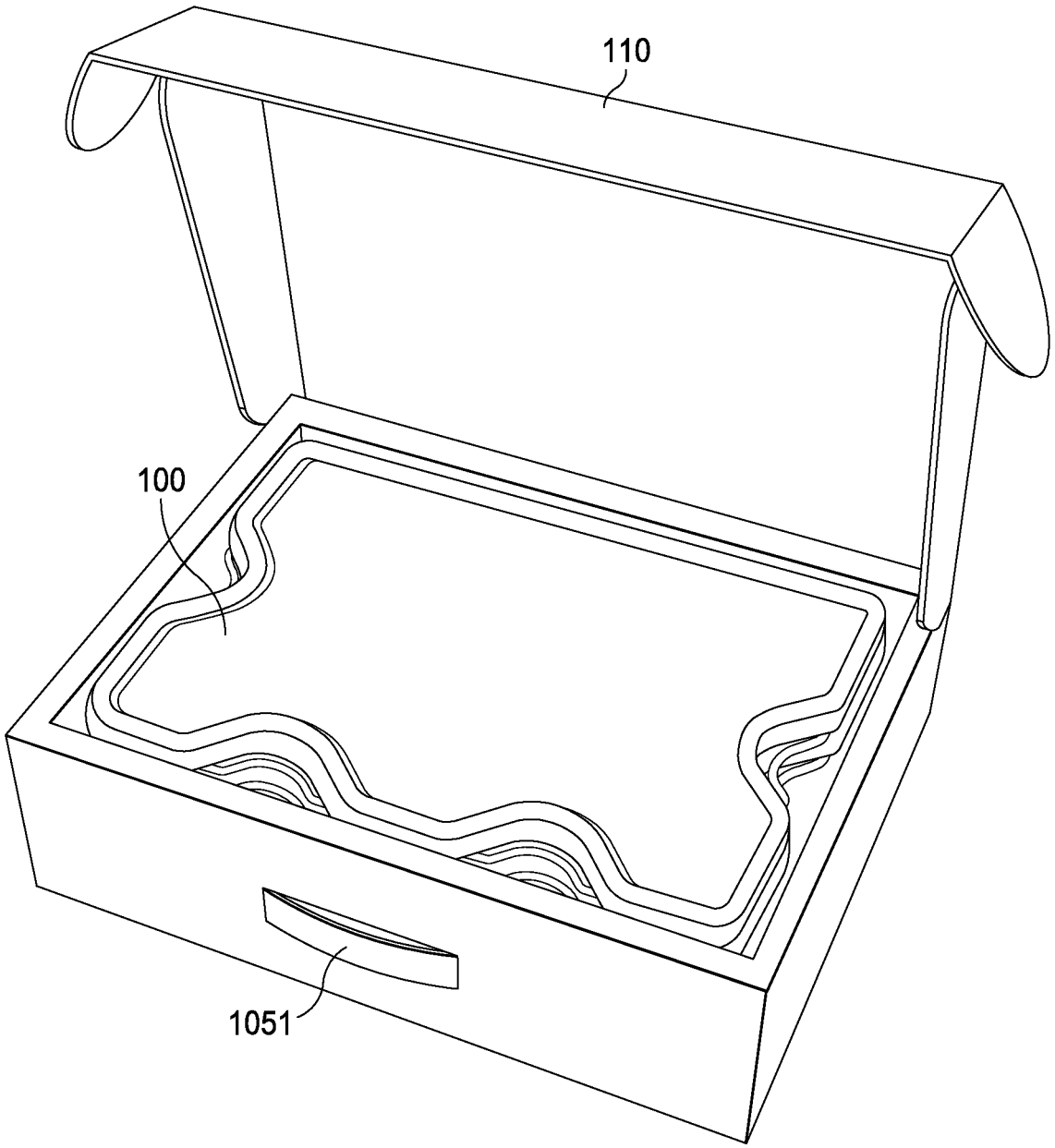
FIG. 8 is a perspective view of an example portable strength training apparatus.

FIG. 8 shows a portable strength training apparatus 100 as it can be delivered, stored, or carried in a container, such as box 110, which can have a handle 1051 for ease of carrying.

Figure 9:
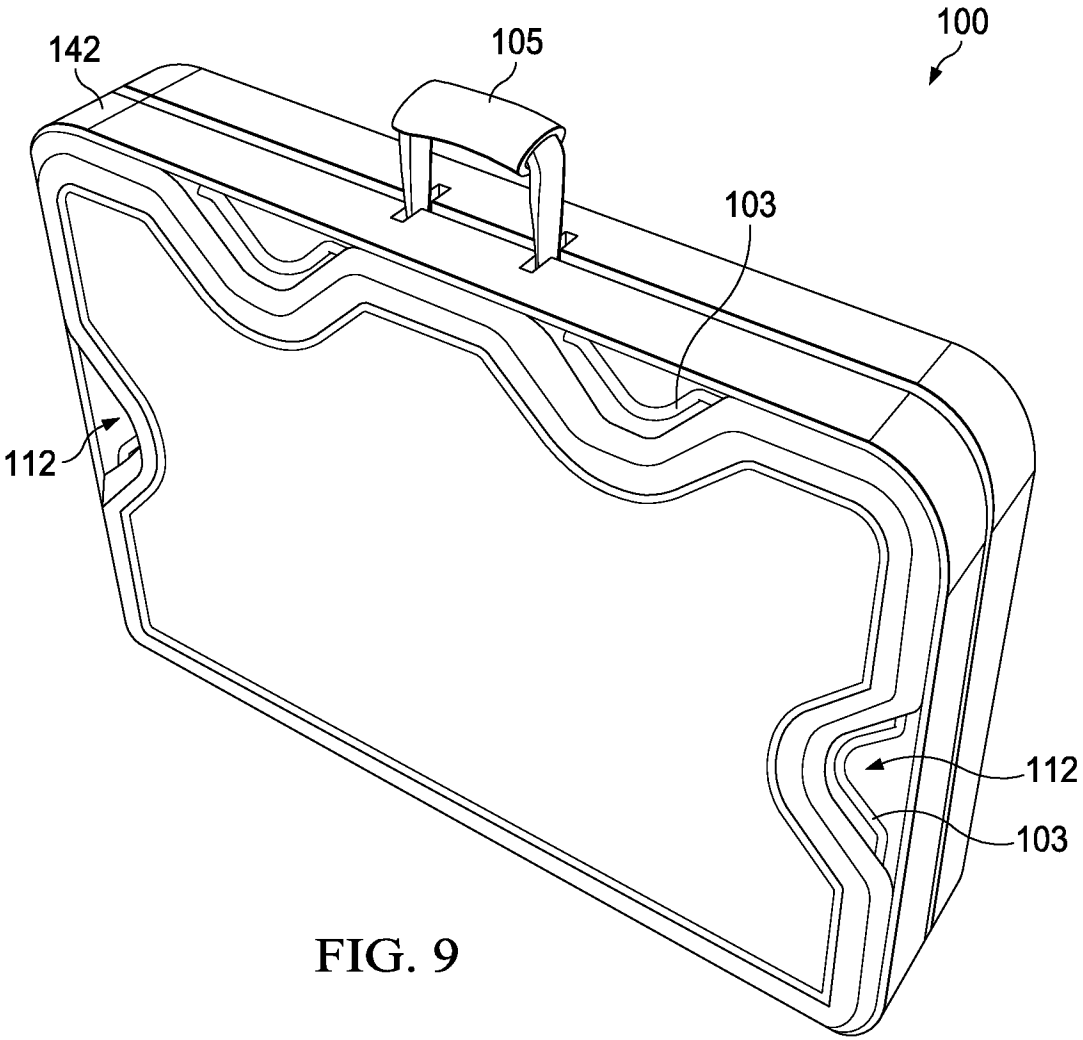
FIG. 9 is a perspective view of an example portable strength training apparatus.

FIG. 9 shows a portable strength training apparatus 100 in a folded state, with a handle 105 and base attachment mechanisms 103 situated within in pockets 112 situated about the perimeter of the platform base 101. The base attachment mechanisms 103 can extend across the wide portion of the pockets 112 and can be attached pivotally, and may be metal, plastic, or another material capable of withstanding the pressure of the resistance bands. The pockets 112 may be placed anywhere about the perimeter 142 of the platform base 101 and there may be any number of pockets 112 and corresponding base attachment mechanisms 103.

Figure 10:
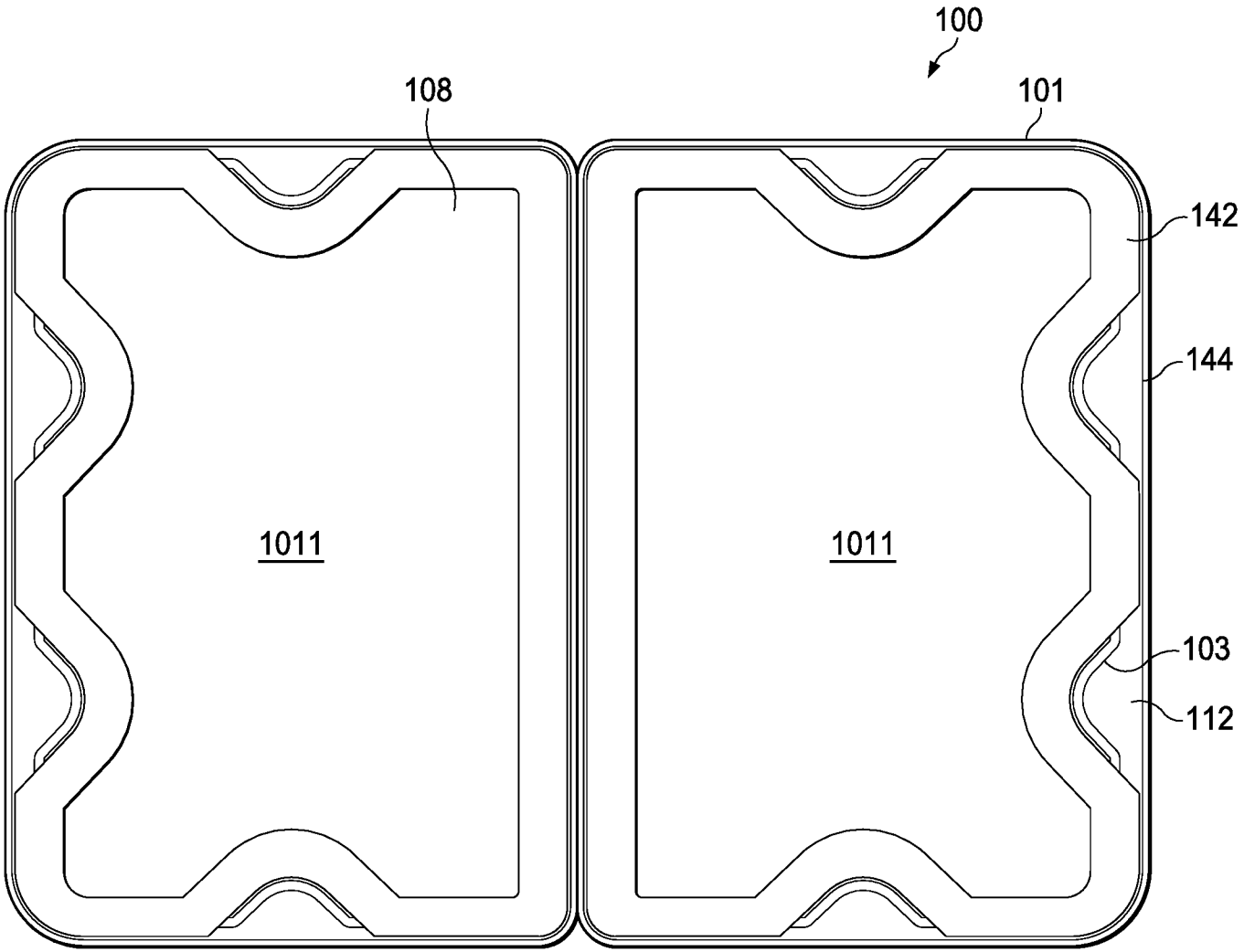
FIG. 10 is a top view of an example portable strength training apparatus.

FIG. 10 shows this embodiment in an unfolded state with the top surface 1011 shown. The top surface 1011 can be partially or substantially fully covered by a slip-resistant surface 108, and the apparatus 100 can have around the perimeter a perimeter bar 144 which can be a band of material to protect and keep clear pockets 112. As with other embodiments disclosed herein, the pivotally attached attachment mechanisms 103 of the embodiment shown in FIGS. 8-10 can approximate an inverted U-shape or V-shape with pins for pivotal attachment to pockets 112. Such an arrangement permits the attachment mechanisms 103 to be folded down for storage or non-use and pivoted up for connection to a resistance band. Thus, in an embodiment, attachment mechanisms 103 can be pivoted from an in-use position in which a connection point to a coupling mechanism 107 is disposed above the top surface 1011, to a storage (or non-use) position in which the attachment mechanism 103 lies below the top surface 1011. In an embodiment, the attachment mechanism 103 storage position can be between the top surface 1011 and the bottom surface 1012.

Figure 11:
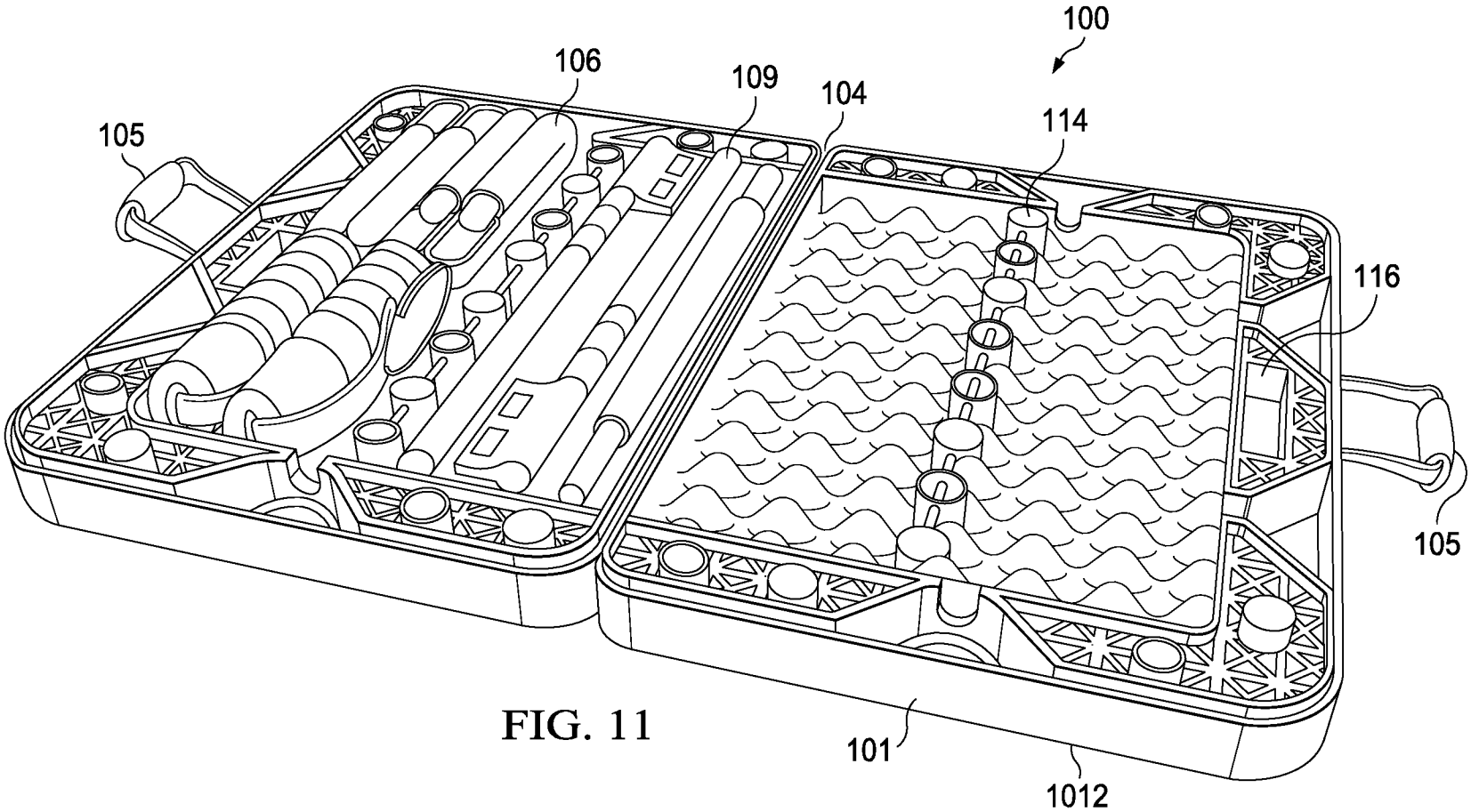
FIG. 11 is a perspective view of an example portable strength training apparatus and system.

FIG. 11 shows an embodiment of a portable strength training apparatus 100 in which portions of the portable strength training apparatus 100 and portable strength training system 200 can be stored inside a folded platform base 101. As shown, for example, various items, such as resistance bands 106 and human interface mechanisms 109 (described more fully below), and other items can be disposed on the bottom surface 1012 side of platform base 101, such that when folded about hinge 104, the items are securely stored inside the portable strength training apparatus 100 for portable transport. When in use, portions of the bottom surface 1012, such as feet 114 can rest on a surface, such as a floor, and can offer a non-slip interface as well as support for the platform base 101 during use.

Figure 12:
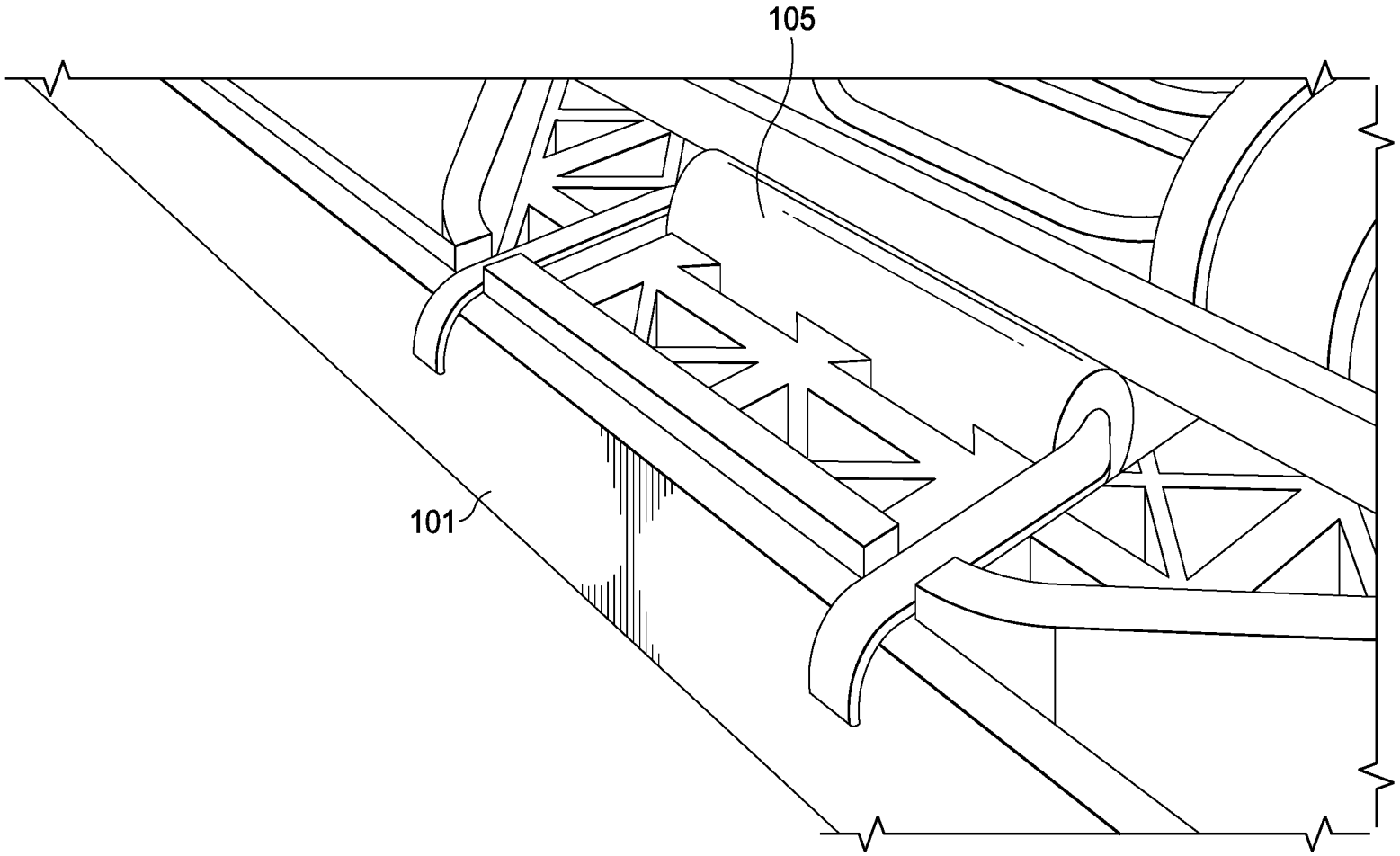
FIG. 12 is a perspective view of a portion of an example portable strength training apparatus.

As shown in FIGS. 11 and 12, handle 105 can be folded, rotated, pivoted, shifted, or otherwise moved from an external position, as shown in FIG. 11, to an internal position, as shown in FIG. 12. In an embodiment, a handle pocket 116 can be provided and handle 105 can be pivotally coupled at handle pivot points 118 to the platform base 101. In an embodiment handle pocket 116 can be formed as an integral portion of an injection molded platform base. In an embodiment, handle pocket 116 can be sized such that handle 105 can be press-fit and held by friction from slipping out. In this manner, handle 105 can be folded and stored out of sight and out of the way during use of the portable strength training apparatus 100.

In general, the base voids 102 or pockets 112 should be large enough to allow coupling between the resistance band and the base attachment mechanism 103. The platform base 101 may be made of plastic, metal, or another material that will not bow or shift when pressure is applied through the resistance bands. The platform base 101 and included base voids 102, pockets 112, and/or and base attachment mechanisms 103 may be formed using common injection molding, stamping, vacuum molding, or welding processes. The platform base 101 may have a relatively low weight to allow a single person to transport the portable strength training apparatus 100. In an embodiment, the portable strength training apparatus 100 can weigh from about 5 to about 25 pounds.

Figure 13:
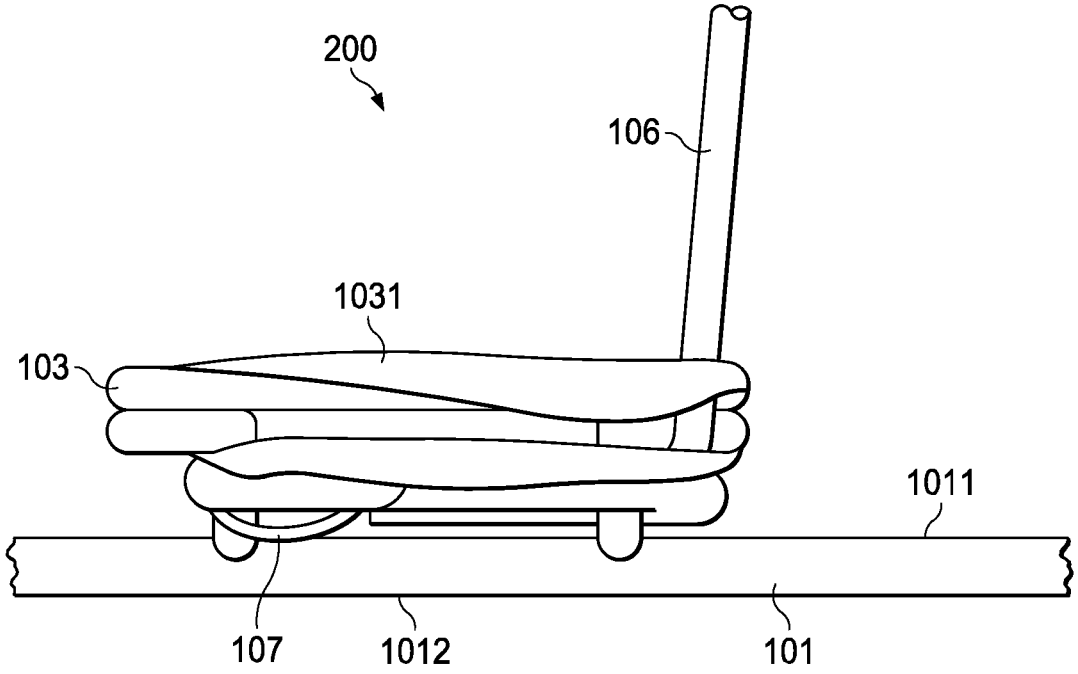
FIG. 13 is side view of a portion of an example portable strength training apparatus.
Figure 14:
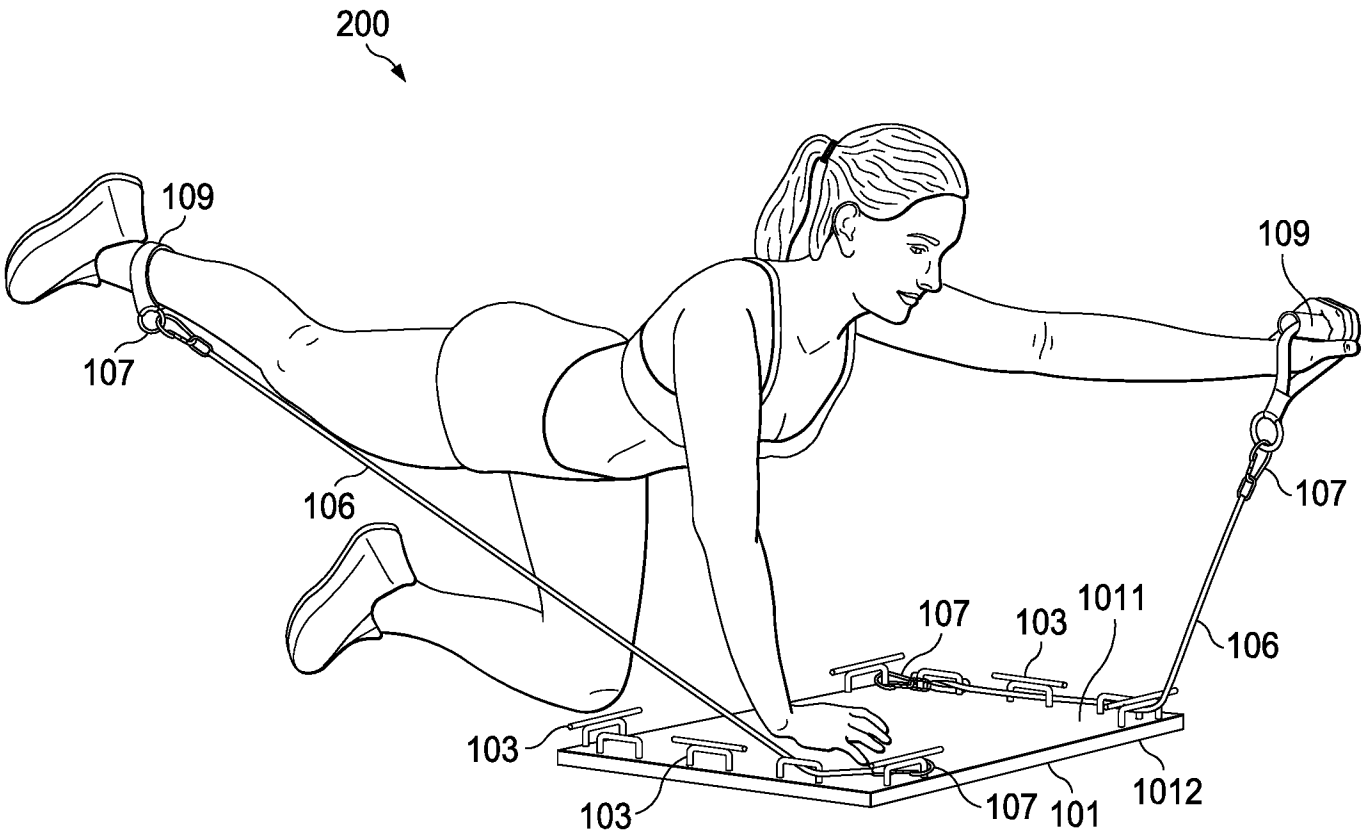
FIG. 14 is a perspective view of an example portable strength training system with base attachment mechanisms extending upward from the top surface of the platform base.

As shown in FIGS. 13 and 14, resistance bands 106 may be wrapped around one or more of the plurality of base attachment mechanisms 103 before or after the resistance band 106 is coupled to one of the plurality of base attachment mechanism 103. The wrapping and weaving of the resistance band 106 shortens the effective length of the resistance band 106, thus increasing the pressure that must be applied to stretch the resistance band 106. The base voids 102 may allow the resistance bands 106 to wrap around and weave through base attachment mechanisms 103.

FIG. 13 depicts a portion of an example portable strength training system 200 with the plurality of base attachment mechanisms 103 extending upward from the top surface 1011 of the platform base 101 when the bottom surface 1012 of the platform base 101 is in contact with the ground. The coupling mechanism 107 allows a resistance band 106 to be removably coupled to one or more of the plurality of base attachment mechanisms 103. The resistance band 106 may be wrapped around one or more of the plurality of base attachment mechanisms 103 before or after the resistance band 106 is coupled to one of the plurality of base attachment mechanism 103. One or more securing mechanisms 1031 can be used to secure resistance bands 106 that are wrapped around or weaved through the base attachment mechanism 103. The securing mechanism 1031 can be elastic band that squeezes the resistance band 106 and part of the base attachment mechanism 103 together to further lock the resistance band 106 during use so the resistance band 106 does not unwind or unweave from the base platform 101 during use.

Figure 15:
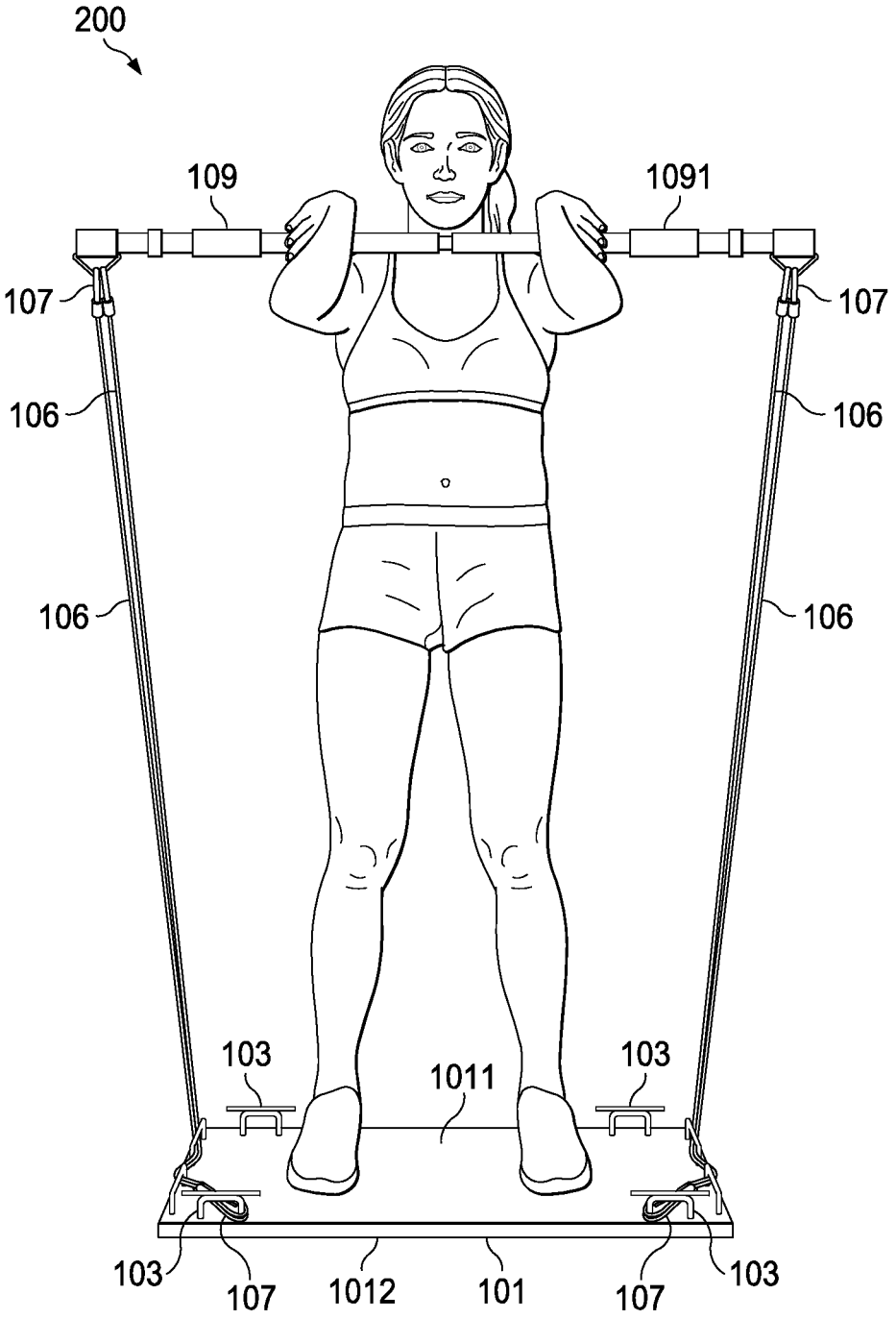
FIG. 15 is a front view of an example portable strength training system with base attachment mechanisms extending upward from the top surface of the platform base.

FIGS. 14 and 15 depict example portable strength training systems 200 with the plurality of base attachment mechanisms 103 extending upward from the top surface 1011 of the platform base 101 when the bottom surface 1012 of the platform base 101 is in contact with the ground. Again, the coupling mechanism 107 allows a resistance band 106 to be removably coupled to one or more of the plurality of base attachment mechanisms 103. Again, resistance bands 106 may be wrapped around one or more of the plurality of base attachment mechanisms 103 before or after the resistance band 106 is coupled to one of the plurality of base attachment mechanism 103. The wrapping and/or weaving of the resistance band 106 shortens the effective length of the resistance band 106, thus increasing the pressure that must be applied to stretch the resistance band 106. In an embodiment, the attachment mechanisms 103 can be uniquely identified, such as by numbering, so that the user can readily "set" a resistance by following a numbered order of coupling and weaving the resistance band. For example, a portable strength training system 200 can include instructions to, for example, "couple a resistance band to attachment mechanism number 1 and weave the resistance band through attachment mechanism number 2," and the like.

The portable strength training systems 200 includes one or more human interface mechanisms 109. The human interface mechanism 109 allow the one or more resistance bands 106 to be stretched by applying pressure to the one or more human interface mechanisms 109. The human interface mechanism can be a hand grip, or an ankle strap as shown in FIG. 14 or a workout bar as shown in FIG. 15, or another strap or grip, such as a wrist strap, a waist strap, or foot grip. Any combination of human interface mechanisms 109 can be applied to vary the maneuver and the angle of the maneuver used to stretch the resistance bands 106 in order to strengthen difference muscles and muscle groups. Coupling the resistance bands 106 to base attachment mechanisms 103 at different locations on the base platform 101 can also vary the maneuver and the angle of the maneuver used to stretch the resistance bands 106 in order to strengthen difference muscles and muscle groups.

When the human interface mechanism is a workout bar as shown in FIG. 15, it may be disassembled into two or more pieces for easier transport, thus further enhancing the portability of portable strength training systems 200 of the present disclosure. Further, in an embodiment, the workout bar 1091 can comprise three pieces, with each a middle piece that can be optionally used. That is, a three-piece workout bar can be full length when all three pieces are used, and can be a shortened length when only two of the pieces are used, for example by removing the middle piece section and connect the two end pieces. In general, the pieces of the workout bar can be screwed together by mating threaded end sections, or snapped together, or press fit together, or the like.

The human interface mechanisms 109 can have a rounded or V-shaped area that allows coupling with multiple resistance bands 106 via the coupling mechanisms 107. The coupling mechanisms 107 may be metal or plastic clips or hooks or another element capable of removably coupling the resistance band 106 to the base attachment mechanisms 103 and the human interface mechanisms 109.

The resistance bands 106 may be of varying length, diameter, and elastic material to allow for varying resistance. The resistance bands 106 may include a protective cover made of cloth or another enclosing material that protects the user of the portable strength training system 200 in case the resistance band 106 breaks during use. As shown in FIG. 15, multiple resistance bands 106 can be used between the same base attachment mechanisms 103 and human interface mechanism 109 to increase the pressure needed to stretch the resistance bands 106. The user of the portable strength training system 200 of the present disclosure can apply downward pressure to the base platform 101 with a hand as shown in FIG. 14 or by standing on the base platform 101 as shown in FIG. 15. The base platform 101 can also be rendered immobile by fixing it to a secure structure, applying weights to the base platform 101, by the user applying pressure to the base platform 101 through a body part, or by a spotter applying pressure to the base platform 101 by standing on it or applying pressure through a body part.

Figure 16:
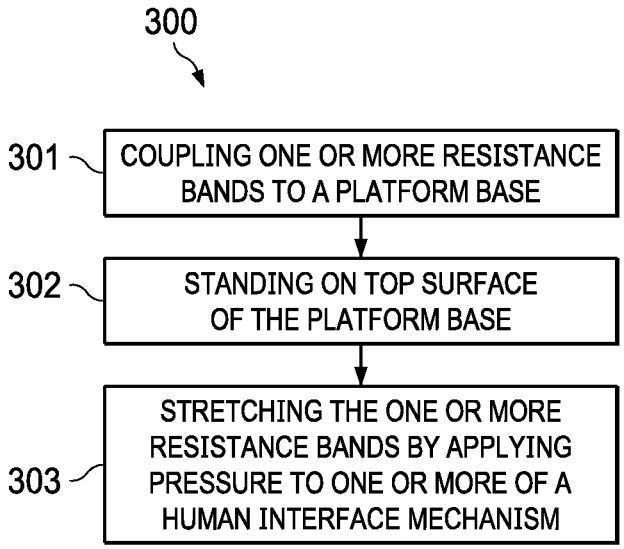
FIG. 16 is a flowchart of an example method for strength training.

FIG. 16 depicts an example of a method for strength training 300 that includes coupling one or more resistance bands to a platform base 301, standing on the top surface of the platform base 302, and stretching one or more resistance bands by applying pressure to one or more human interface mechanisms 303. The method for strength training 300 may use the portable strength training apparatus 100 and portable strength training system 200 described above.

Figure 17:
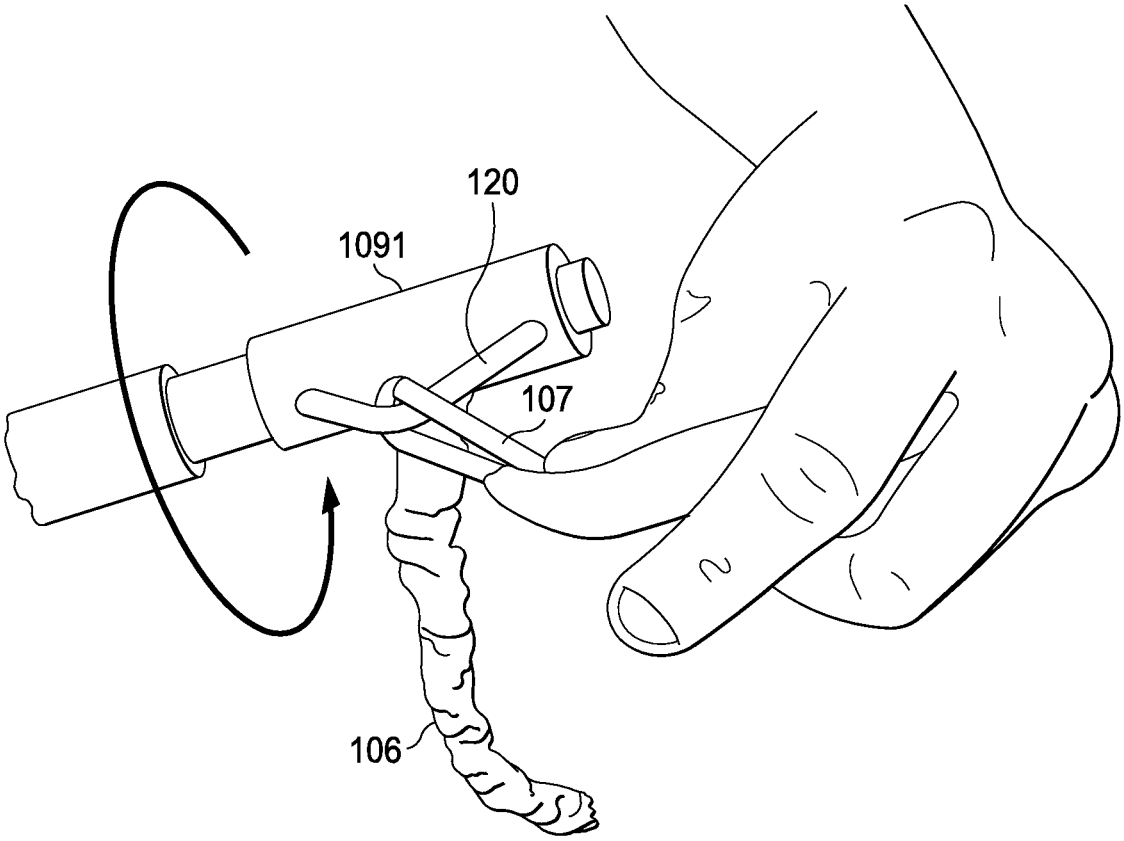
FIG. 17 is a perspective view of a portion of a human interface mechanism on an example portable strength training apparatus.

In an embodiment, portions of the human interface mechanisms 109 can be moveable to aid in smoother movement during a workout. For example, as depicted in FIG. 17, rotatable sleeve portions 120 of a workout bar 1091, such that the rotatable sleeve portion 120 is free to rotate as indicated. When a coupling mechanism 107 is connected to the rotatable sleeve portion 120, the rotatable sleeve portion 120 permits free rotational movement such that during a workout with the workout bar 1091 (or other human interface mechanism 109), the resistance bands 106 coupled to the workout bar 1091 are not unduly bound in a twisted configuration.

FIGS. 18-22 depict various non-limiting examples of portable strength training systems 200 in which a force sensor 122 is operatively coupled to the portable strength training system 200. A force sensor 122 can be physically and electrically coupled to track, record, and/or analyze the resistance experienced by a user during a workout. A force sensor, as more fully detailed below, can have a force transducer that converts an input mechanical force into an electrical output signal. In an embodiment, the force sensor 122 acts as a force sensing resistor in an electrical circuit. When the force sensor is unloaded, its resistance is very high. When a force is applied to the sensor, for example by the resistance bands, this resistance decreases. The resistance can be measured and converted to an output signal of measured force.

In an embodiment, the force sensor 122 can be programmed to detect, measure, store, and/or transmit force values applied to the resistance band. In an embodiment, the force sensor 122 can be programmed to detect, measure, and/or transmit force values to an external device or the cloud, where data is then stored. The term "applied to" refers to the force induced in the resistance band, or in other terms, the force experienced by the resistance band. In an embodiment, the force sensor 122 can be programmed to detect a minimal threshold force value, such as one pound. In an embodiment, the force sensor 122 can be programmed to measure a maximum force value, such as 44 pounds, or 88 pounds, or 200 pounds or more. In an embodiment, force sensor 122 can be programmed to detect, measure, store, and/or transmit cyclic force value data on a regular time interval after a minimal threshold force is detected, such as every second (one value per second), every half second (two values per second), every tenth of a second (ten values per second), or every two-tenths of a second (five times per second).

In an embodiment, force sensor 122 can be programmed to detect when a repetitive, cyclic force change ends, and detect, store and/or transmit "rest" time data. In an embodiment, forces sensor 122 includes wireless transmission capability, such as Bluetooth® capability, to wirelessly transmit data to an external receiver, such as a computer, smartphone, or other device.

In an embodiment, an application on an external device to which data is transmitted wirelessly can detect "rest" time data, as well as other data such as total force experienced, number of "reps," and the like. That is, in an embodiment, the force sensor 122 wirelessly transmits force (or resistance) data to an external device on which is running a paired application that can convert and store the data. The data can be reported on the paired application as discussed below. Further, the data can be transmitted to a third party device, such as the computer or smartphone of a doctor, trainer, insurance company, and the like, as discussed below.

Figure 18:
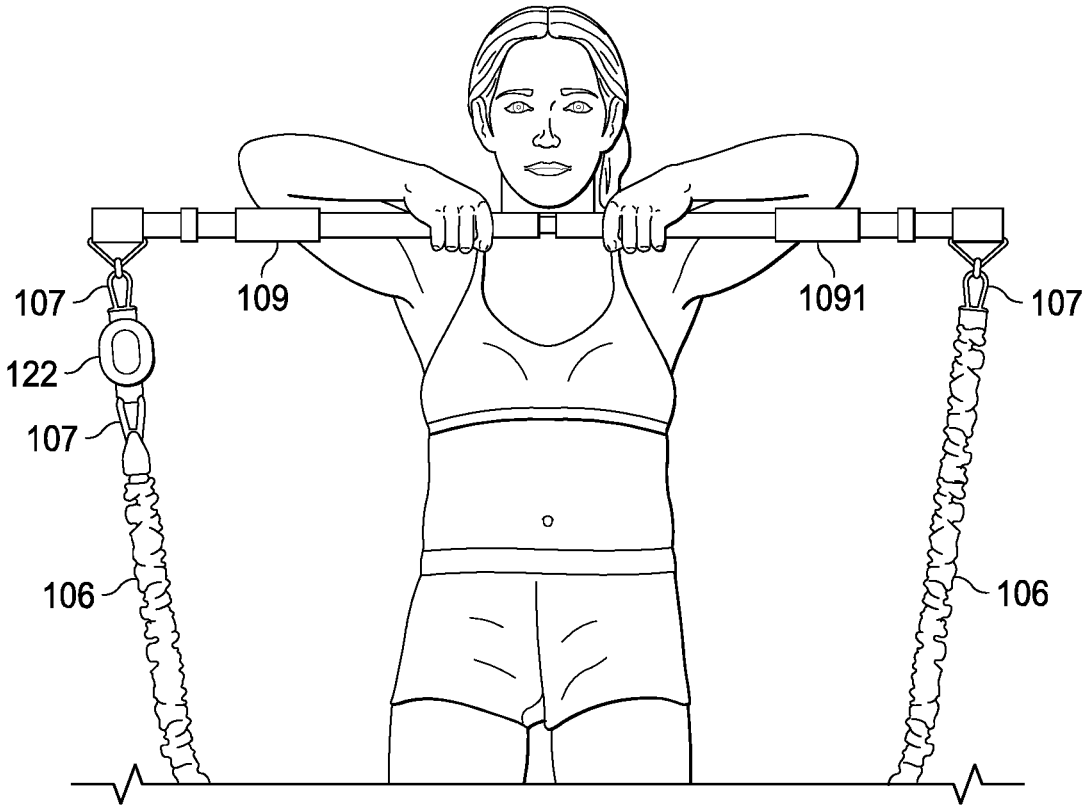
FIG. 18 is a front view of an example portable strength training system with a force sensor.

FIG. 18 depicts an embodiment comprising a force sensor 122 coupled in line with a resistance band 106. During a workout, the force sensor 122 can detect and quantify, i.e., measure, the force, such as the tensile force, experienced in resistance band. When one force sensor 122 is used, the force sensor can be programmed to compensate, for example by doubling the force measurement, to account for a more true resistance force experienced by the user using two resistance bands. The force measurement can be detected, stored, or transmitted for further analysis and review by the user or another, such as a personal trainer, doctor, or insurance company.

Figure 19:
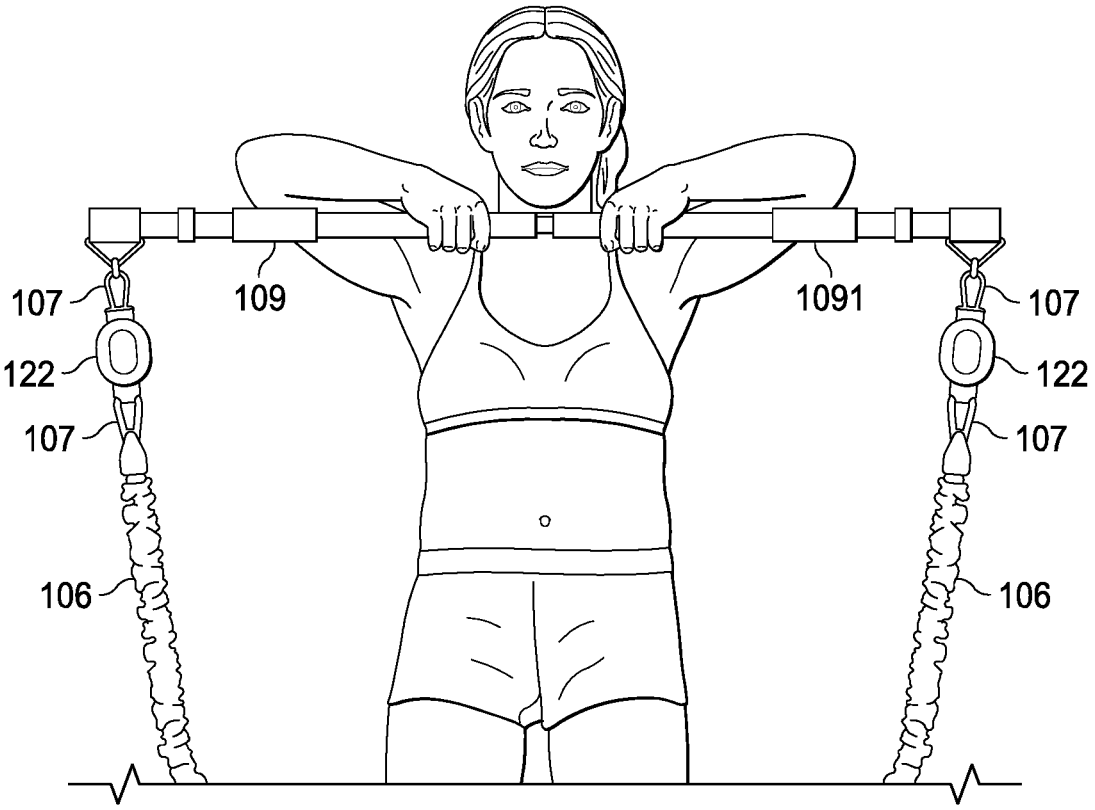
FIG. 19 is a front view of an example portable strength training system with two force sensors.

FIG. 19 depicts an embodiment comprising two force sensors 122, each coupled in line with a resistance band 106. During a workout, each force sensor 122 can measure the force, such as the tensile force, experienced in its respective resistance band, and the force sensor can compensate, such as by adding the force measurements, to account for a more true resistance force experienced by the user. The force measurement can be detected, stored, or transmitted for further analysis and review by the user or another, such as a personal trainer, doctor, or insurance company. In this embodiment, both force sensors can be paired with a single device, thus reporting data to that device.

Figure 20:
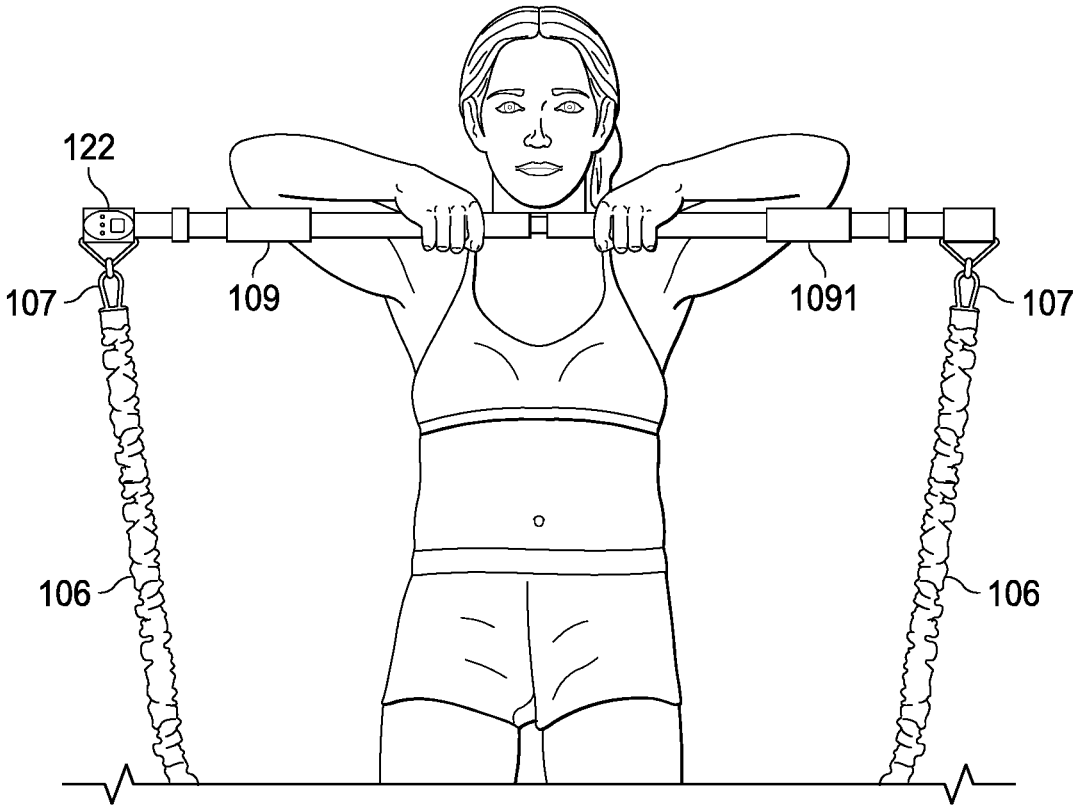
FIG. 20 is a front view of an example portable strength training system with a force sensor.

FIG. 20 depicts an embodiment comprising a force sensor 122 built into a human interface mechanism 109, which in the illustrated embodiment is a workout bar 1091. The force sensor can be externally visible, or embedded internally to the human interface mechanism 109. In this embodiment, the resistance band 106 can be coupled directly to the force sensor 122, which can be an integral part of the human interface mechanism 109. During a workout, the force sensor 122 can detect the force, such as the tensile force, experienced in resistance band. When one force sensor 122 is used, the force sensor can be programmed to compensate, for example by doubling the force measurement, to account for a more true resistance force experienced by the user. The force measurement can be detected, stored, or transmitted for further analysis and review by the user or another, such as a personal trainer, doctor, or insurance company.

Figure 21:
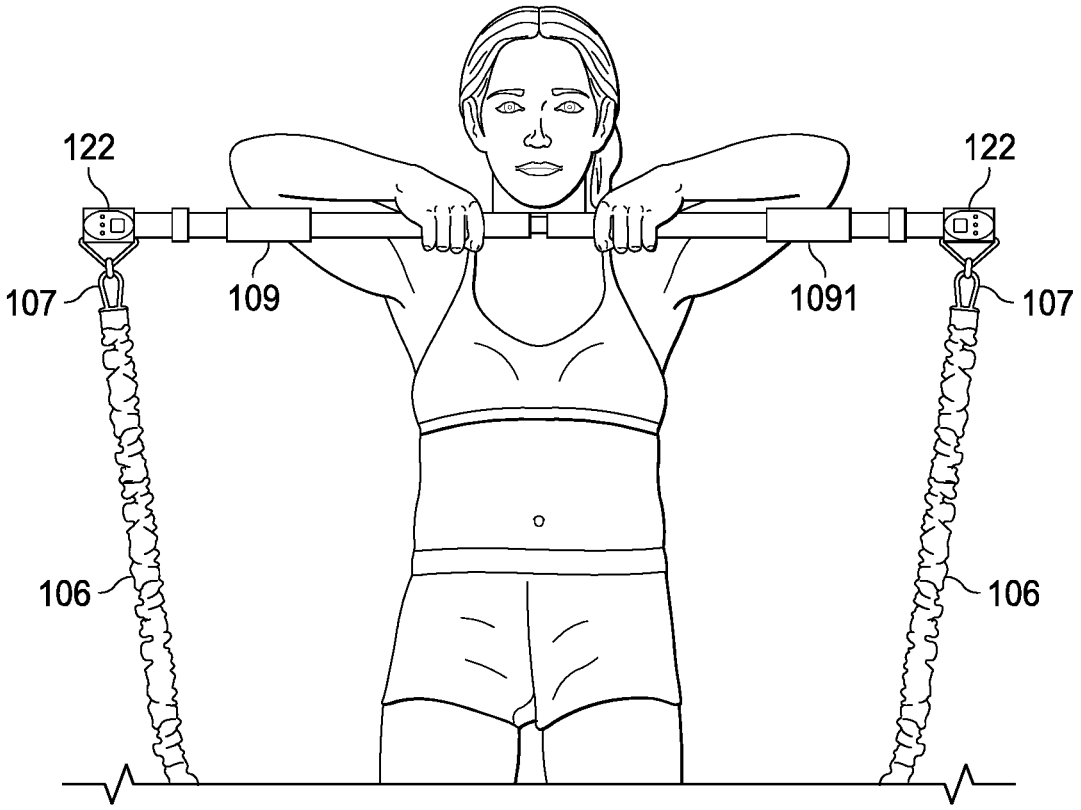
FIG. 21 is a front view of an example portable strength training system with two force sensors.

FIG. 21 depicts an embodiment comprising two force sensors 122 each built into a human interface mechanism 109, which in the illustrated embodiment is a workout bar 1091. During a workout, each force sensor 122 can detect the force, such as the tensile force, experienced in its respective resistance band, and the force sensor can compensate, such as by adding the force measurements, to account for a more true resistance force experienced by the user. The force measurement can be detected, stored, or transmitted for further analysis and review by the user or another, such as a personal trainer, doctor, or insurance company.

Figure 22:
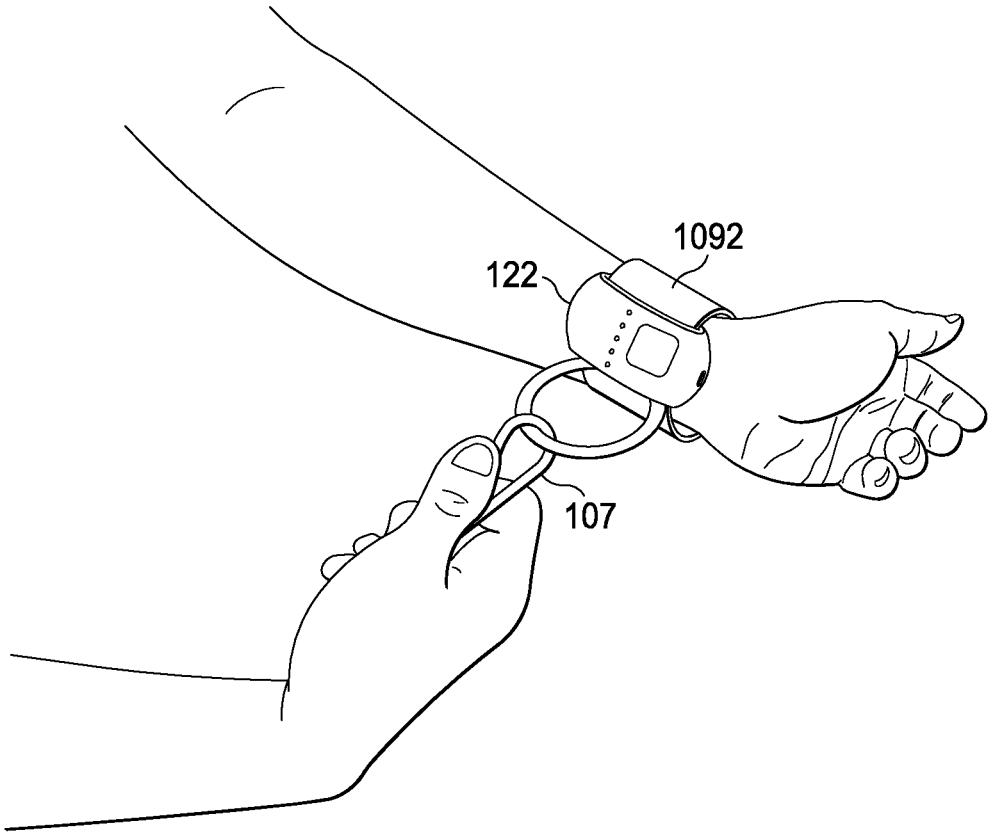
FIG. 22 is a perspective view of an example portable strength training system with a force sensor on a human interface mechanism.

FIG. 22 depicts an embodiment comprising a force sensor 122 built into a human interface mechanism 109, which in the illustrated embodiment is a wrist strap 1092. In this embodiment, the resistance band 106 can be coupled directly to the force sensor 122, which can be an integral part of the human interface mechanism 109. During a workout, the force sensor 122 can detect the force, such as the tensile force, experienced in resistance band. When one force sensor 122 is used, e.g., on one wrist band 1092, the force sensor can be programmed to compensate, for example by doubling the force measurement, to account for a more true resistance force experienced by the user. However, for human interface mechanisms 109 such as wrist bands 1092, it may be more useful to report the force as is. The force measurement can be detected, stored, or transmitted for review by the user or another third party device, such as a computer of a personal trainer, doctor, or insurance company.

Figure 23:
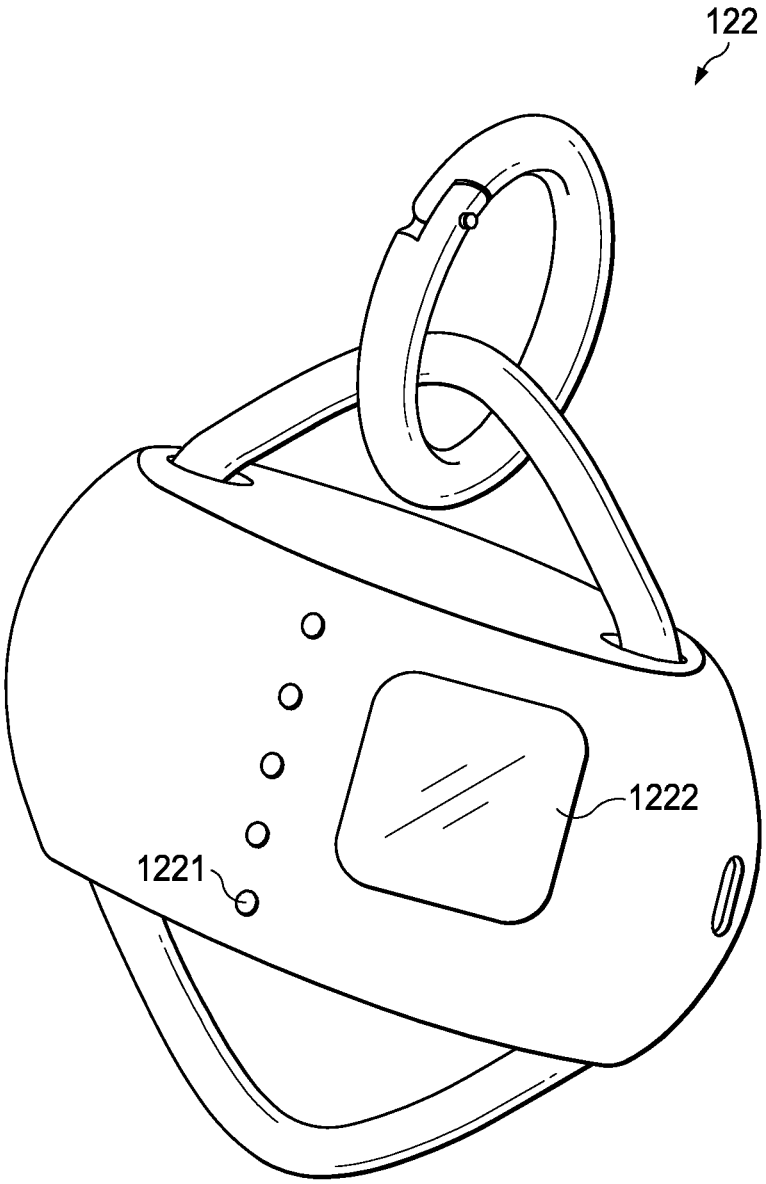
FIG. 23 is a perspective view of an example force sensor.

FIG. 23 depicts one embodiment of a force sensor 122. In the illustrated embodiment, force sensor 122 is configured to be coupled in-line with a resistance band 106, as depicted in FIGS. 18 and 19. The force sensor 122 can have externally visible indicator lights 1221, or other externally-viewable indicia, including a screen 1222 showing, for example, force value data. Indicator lights can indicate, for example, the relative force applied to a resistance band and/or the power status of the force sensor power supply. In an embodiment, a plurality of LED lights can be used, with the lights indicating to a user or others increased force (i.e., increased resistance). In an embodiment, the increased force can be indicated by color, such that the plurality of lights can sequence from, for example, green to red with increased force.

Figure 24:
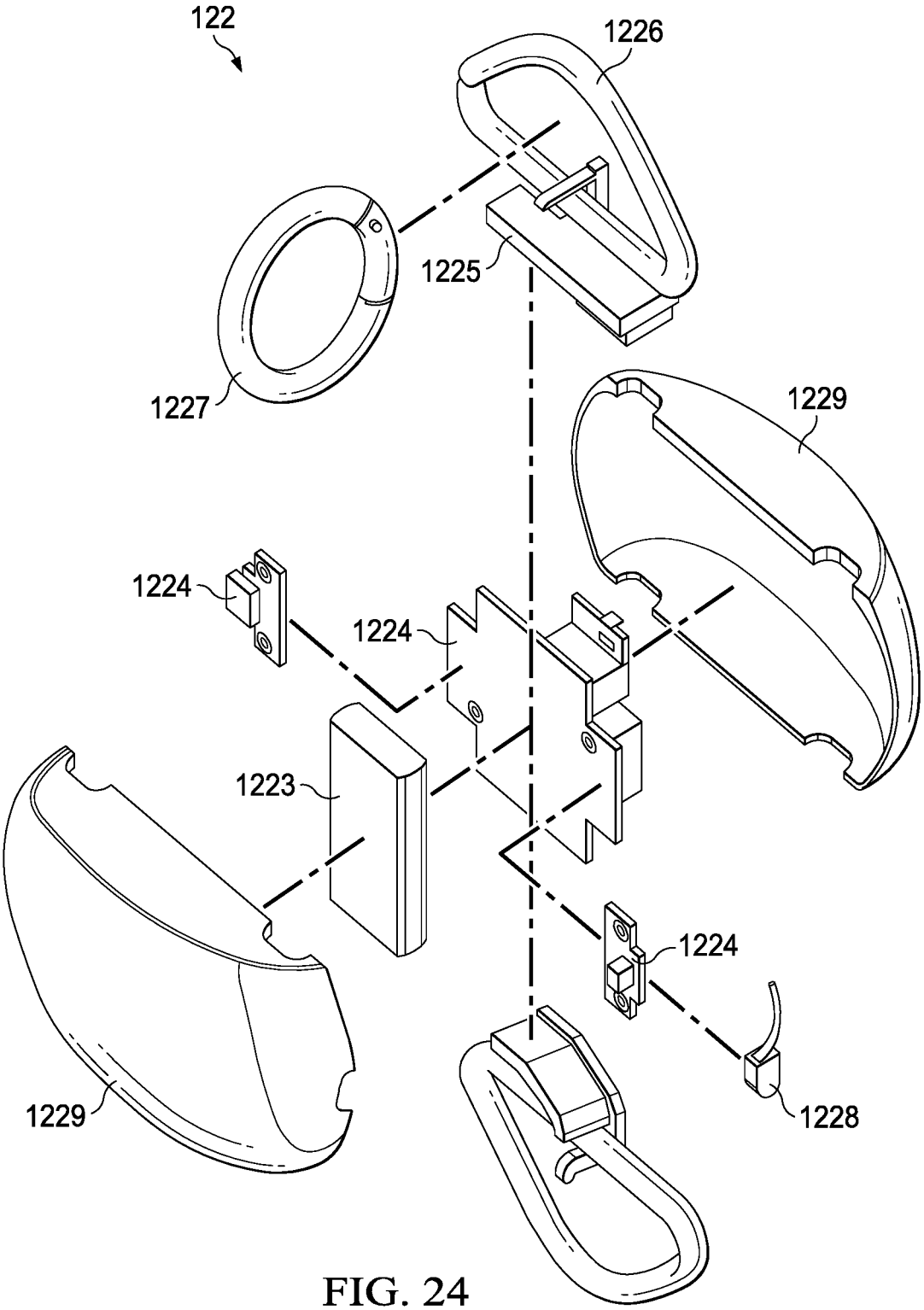
FIG. 24 is an exploded view of an example force sensor.

As shown in the exploded view of FIG. 24, a force sensor 122 can include a power supply 1223, electronic circuitry 1224, a force sensing module 1225, a hook 1226, a ring 1227, and an actuator button 1228. The force sensor 122 can be housed in a housing 1229, which can be a two-part housing, as depicted in FIG. 24.

The force sensing module 1225 can include any of known force transducers, including strain gauge load cells, such as foil strain gauges, semiconductor strain gauges, thin-film strain gauges, and wire strain gauges; piezoelectric crystal, including multi-component piezoelectric force transducers; pressure detectors, such as hydraulic or pneumatic load cells; elastic devices, magneto-elastic devices, vibrating elements, dynamic devices, and plastic deformation.

The electronic circuitry 1224 can include an RF clock, an RF circuit, an RF clock buffer, an application processor, a Bluetooth transceiver module, a Bluetooth RF transceiver, and a Bluetooth antenna, and can be configured for wireless transmission of detected force data by means known in the art.

Figure 25:
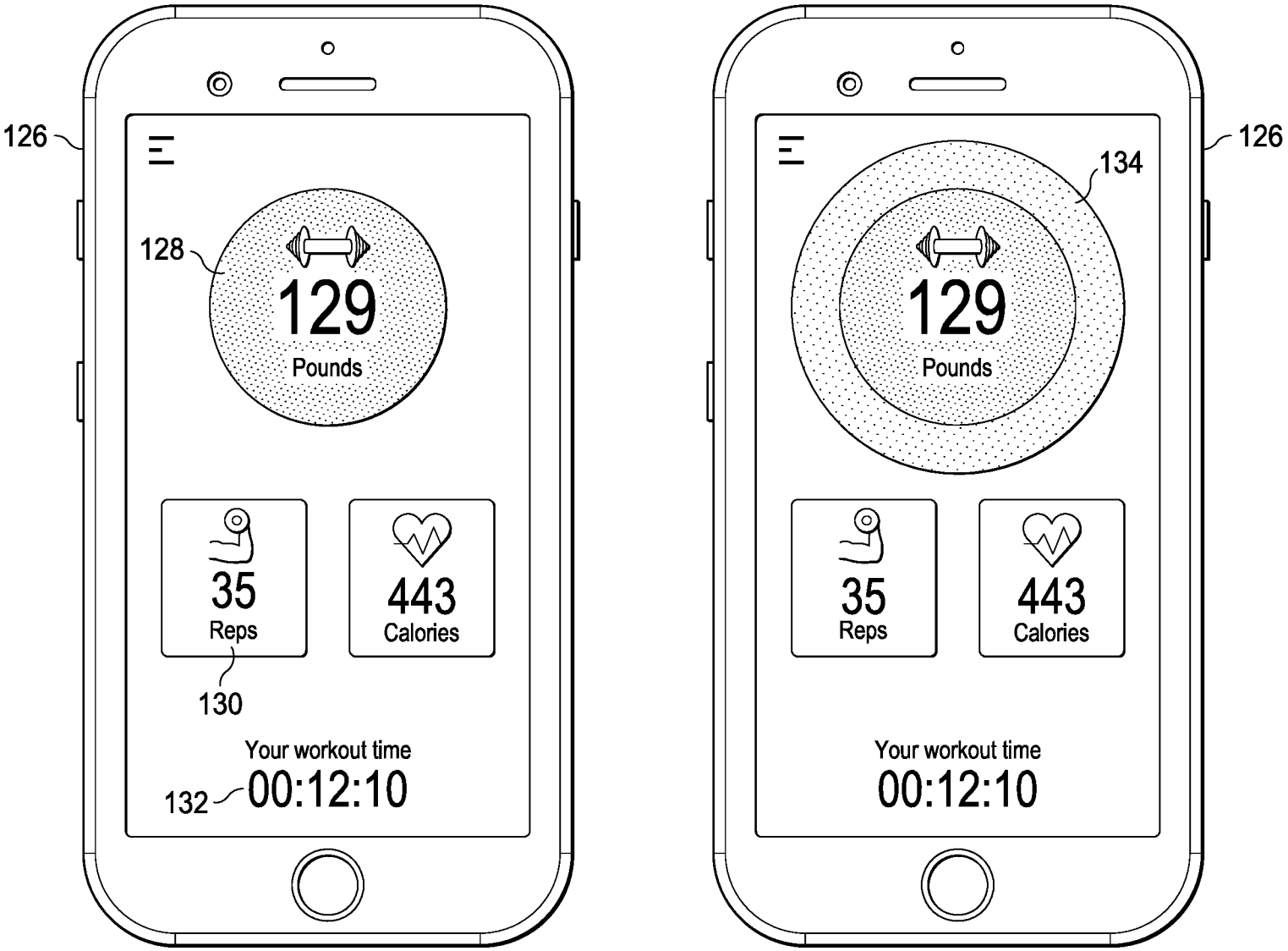
FIG. 25 is a front view of an example electronic device receiver of data.
Figure 26:
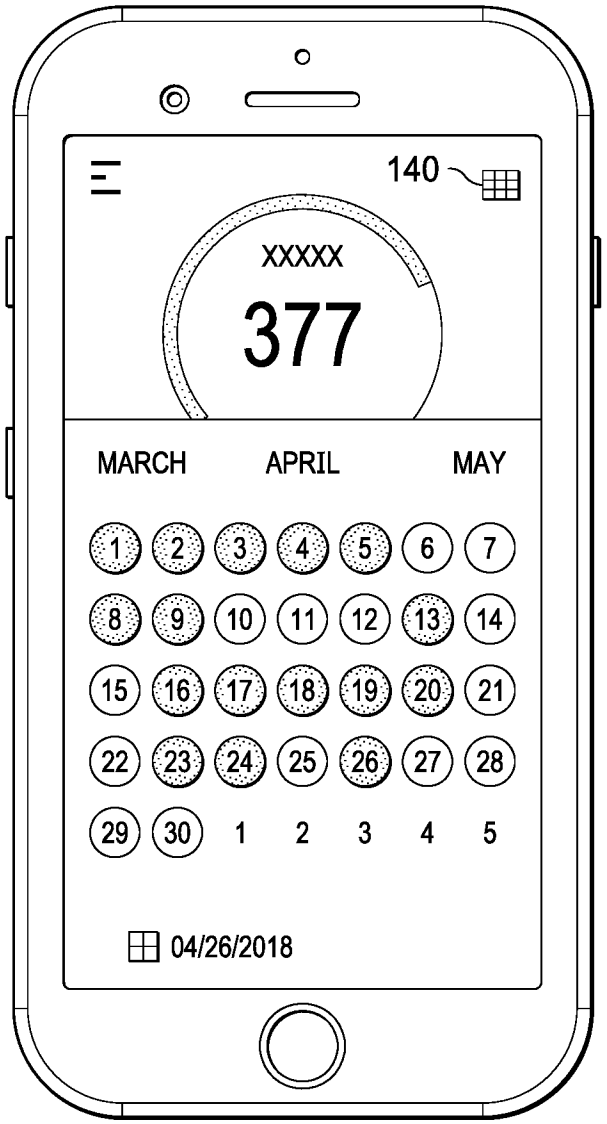
FIG. 26 is a front view of an example electronic device receiver of data.
Figure 26:
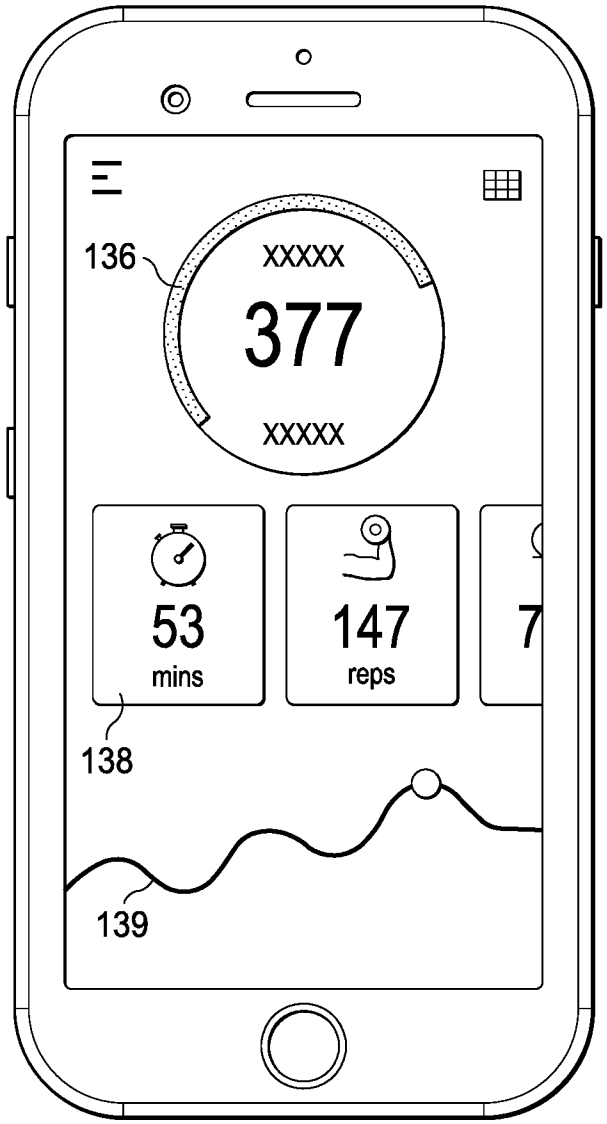

FIGS. 25 and 26 show representative, non-limiting, examples of data that can be transmitted to an external device, such as a smartphone 126. As depicted in FIG. 25, for example, showing two smartphones with data displayed, an application on the external device can receive data including current data, such as weight, e.g., pounds, lifted 128, and can calculate and report other information, such as maximum pounds, average pounds, or other weight reporting. The transmitted and received data and/or calculated and reported information can also include the number of cycles, or repetitions, commonly called "reps" and the number of calories burned 130, as well as the time of the workout, 132 for an exercise session. A "rep" can be correlated with one peak force measurement as measured by the force sensor 122. The transmitted, received or calculated data can also indicate real time phenomena, such as by indicated by pulsing circles 134 to show that the resistance force being measured is increasing or decreasing. In general, an application on an external device can report at least four pieces of information: (1) force (resistance) measured at any moment; (2) force (resistance) total per session; (3) time of a session; and, (4) the percent of time of the session that was under force (resistance).

In addition to current data, periodic, e.g., daily, data can be transmitted and received. As depicted in FIG. 26, for example, showing two smart phones with data displayed, an indication of total weight, e.g., pounds, 136 for the period can be displayed. Total time and reps 138 can be displayed, as well as a graph 139 for the periodic, e.g., daily performance data. Tapping a calendar button 140 can bring up historic data.

Figure 27:
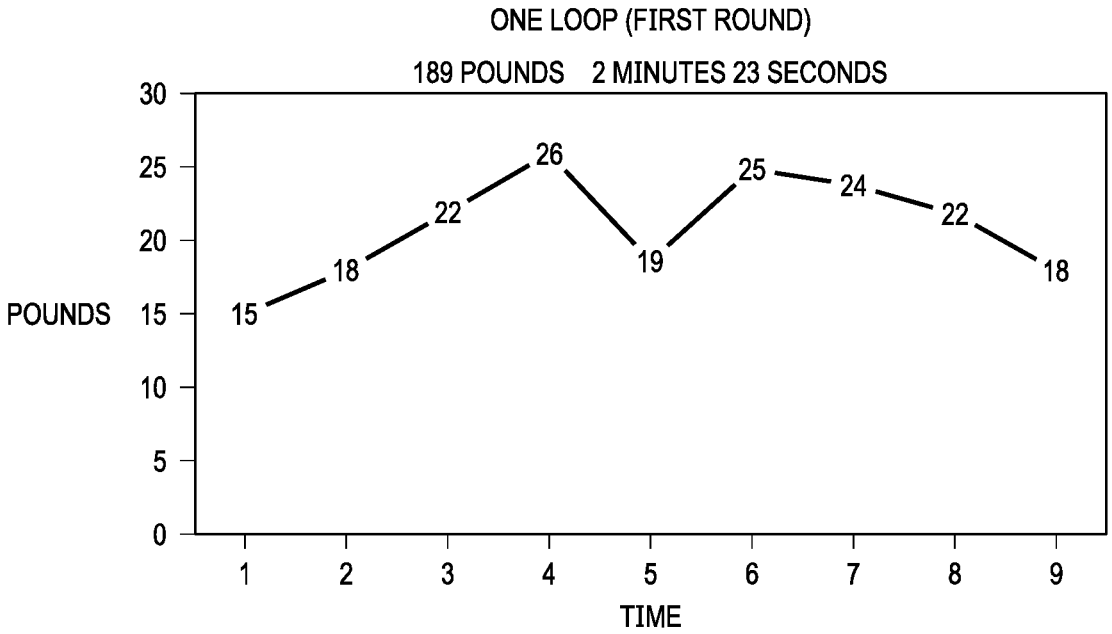
FIG. 27 is graphical representation of example data displayed by the portable strength training system.
Figure 28:
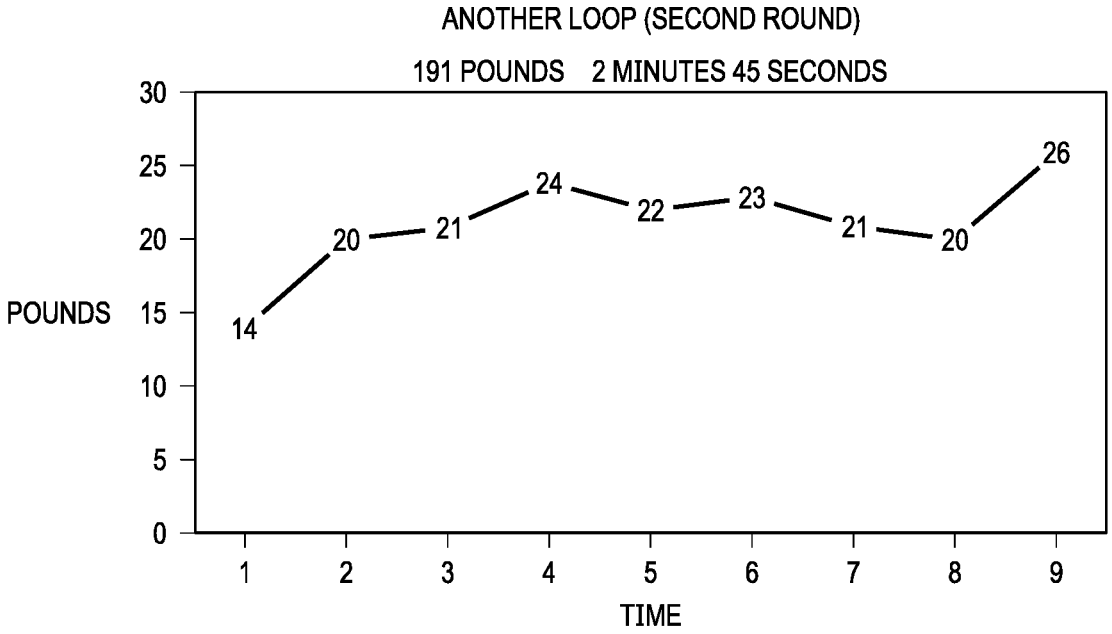
FIG. 28 is graphical representation of example data displayed by the portable strength training system.
Figure 29:
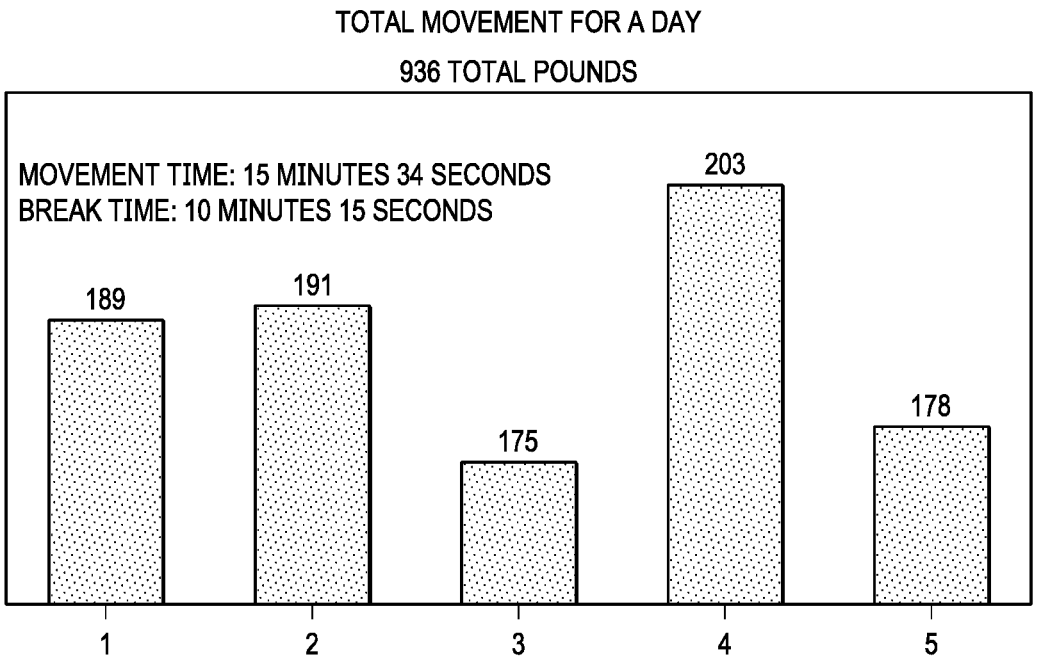
FIG. 29 is graphical representation of example data displayed by the portable strength training system.
Figure 30:
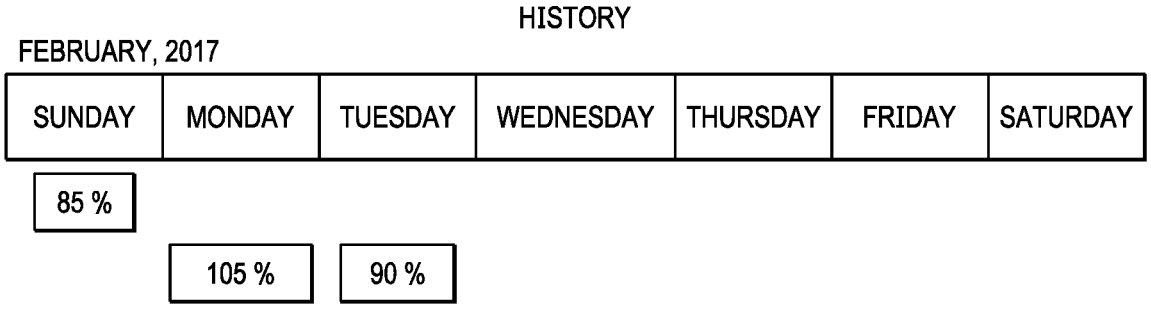
FIG. 30 is graphical representation of example data displayed by the portable strength training system.

Referring to FIGS. 27-30, there is depicted an example embodiment of the portable strength training system 200 and method 300 being reported. As shown in FIG. 27, a first loop, e.g., a first round, of resistance forces can be transmitted, received, and reported graphically. As shown in FIG. 28, a second loop, e.g., a second round, of resistance forces can be transmitted, received, and reported graphically. As shown in FIG. 29, a periodic, e.g., daily, representation of total weight, e.g., pounds, can be graphically displayed. And as depicted in FIG. 30, a graphical display of all historic data can be transmitted, received, stored, and displayed.

The force sensors and resistance bands as described above can be used without a platform base. For example, in an embodiment, a resistance band and force sensor can be used in an apparatus that utilizes human interface mechanisms 109 anchored to relatively immovable objects.

In an embodiment, a resistance band can be anchored to a door. For example, one or more resistance bands can be coupled at one respective end with one or more corresponding human interface mechanisms 109, with a force sensor 122 incorporated in either the resistance band or the human interface mechanism 109. The other end of each resistance band 106 can be coupled to a door, a door frame, or the like. For example, the other end of each resistance band 106 can be coupled to a frame that can be secured to the top of a door, thereby providing a relatively immovable anchor. Securement to the door can be achieved via a simple hooking mechanism, or it can be achieved via a clamp. Further, securement on the door can be achieved by any of known relatively permanent securements, such as by bolting, screwing, nailing, adhering, and combinations thereof.

In an embodiment, a resistance band can be anchored to a pole. For example, one or more resistance bands can be coupled at one respective end with one or more corresponding human interface mechanisms 109, with a force sensor 122 incorporated in either the resistance band or the human interface mechanism 109. The other end of each resistance band 106 can be coupled to a pole. For example, the other end of each resistance band 106 can be coupled to a pole secured into a floor and/or ceiling, thereby providing a relatively immovable anchor. Securement to the pole can be achieved via a simple strapping feature, or it can be achieved via a hook or clamp. Further, securement on the pole can be achieved by any of known relatively permanent securements, such as by bolting, screwing, nailing, adhering, and combinations thereof.

Figure 33:
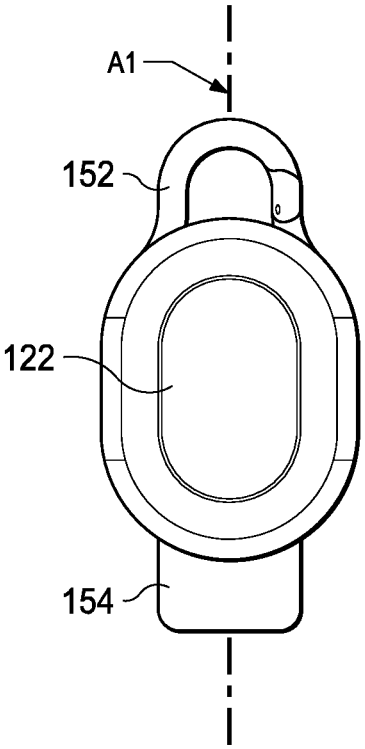
FIG. 33 is a front elevation view of an example force sensor having integrated connections.
Figure 34:
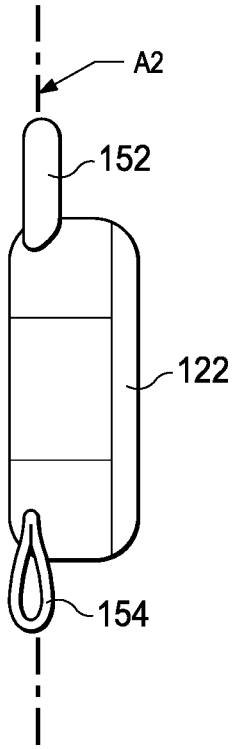
FIG. 34 is a side view of an example force sensor having integrated connections.
Figure 35:
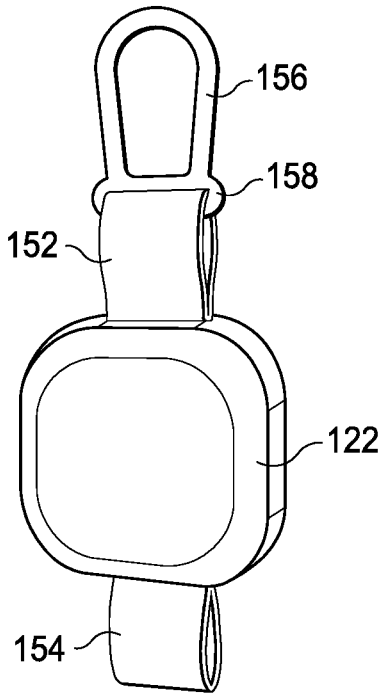
FIG. 35 is a perspective view of an example force sensor having integrated connections.
Figure 36:
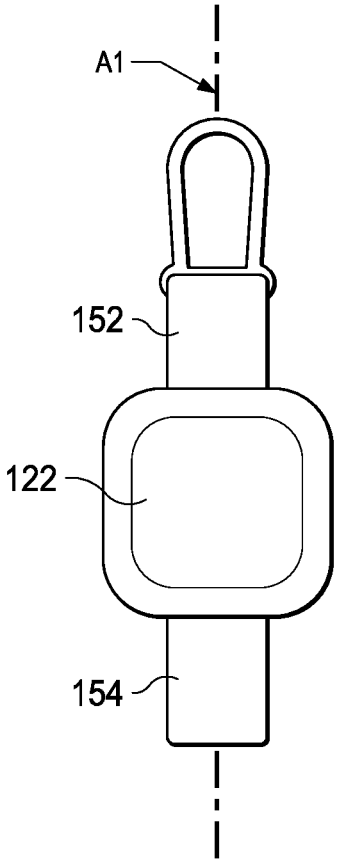
FIG. 36 is a front elevation view of an example force sensor having integrated connections.
Figure 37:
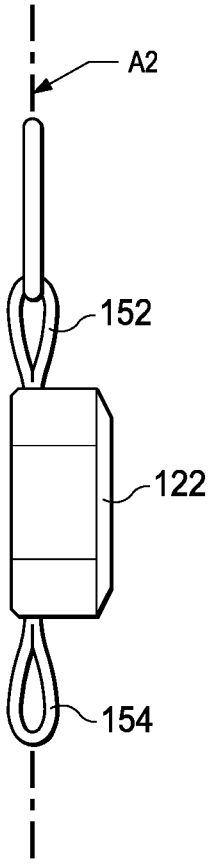
FIG. 37 is a side view of an example force sensor having integrated connections.

Further beneficial structures can be utilized to increase the versatility of the above mentioned functional components, as shown in FIGS. 31-40. In the illustrated embodiments, as throughout this description, terms of orientation such as "up" and "down" are used with respect to the depicted FIGS. Thus, for example "up" or "upwardly" corresponds to "toward the top of the page". In FIGS. 33 and 36 the front of force sensor is depicted, and the illustration shows details from side to side. In FIGS. 34 and 37, the side of a force sensor is depicted and the illustration shows details from front to back.

Figure 31:
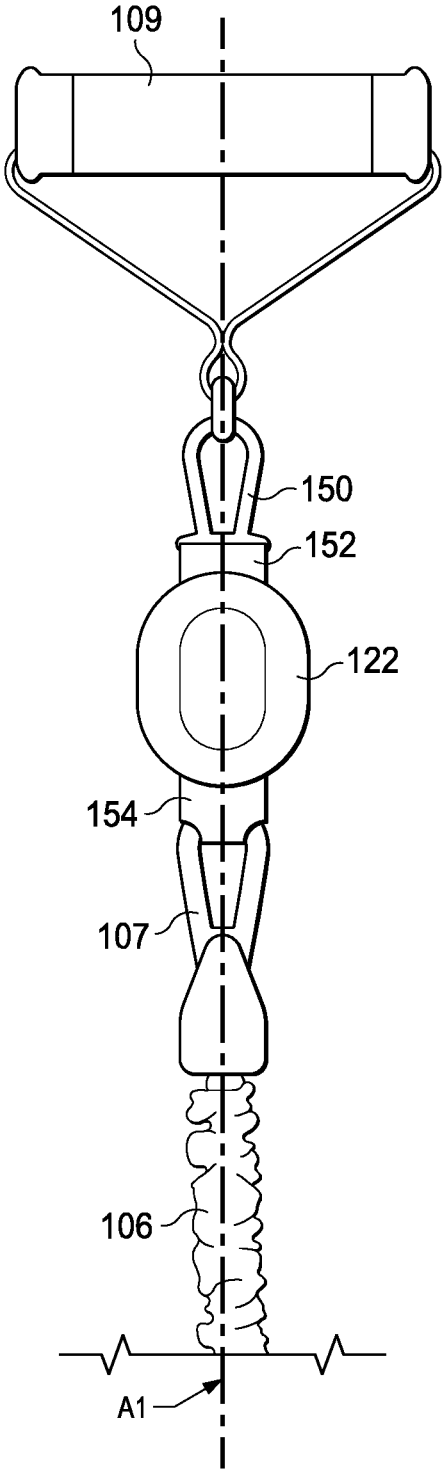
FIG. 31 is a front view of an example force sensor connected to a resistance band and a human interface device.
Figure 32:
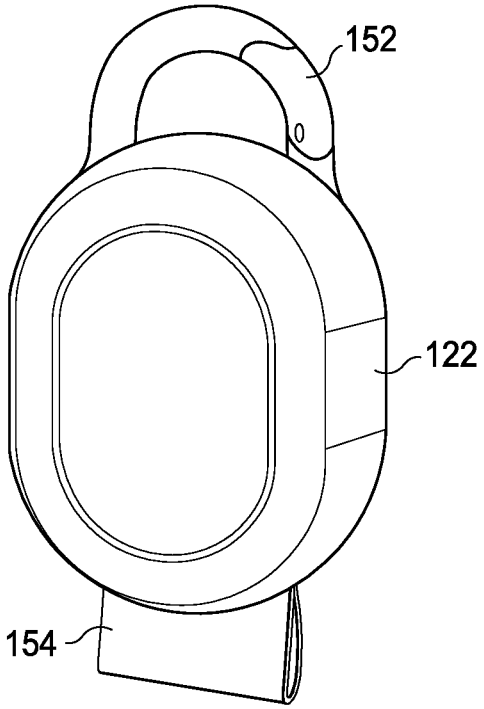
FIG. 32 is a perspective view of an example force sensor having integrated connections.

Referring now to FIG. 31, force sensor 122 can have integrated connection members, including a first integrated connection member 152 and a second integrated connection member 154. In the orientation shown in FIG. 31, the first and second integrated connection members 152 and 154 can be considered upper and lower connection members, respectively, and can extend upwardly and downwardly, respectively, in alignment with the linear orientation of a resistance band 106, as indicated by axis A1. Axis A1 can be in a plane that effectively bisects the first and second connection members, as well as the force sensor. First integrated connection member 152 and/or second integrated connection member 154 can be, can include, or have joined to it, a carabiner or carabiner-type connector 150 for easy connection, such as to a human interface mechanism 109. By carabiner-type is meant a connector that may not be a complete, discrete carabiner, but can have the essential working parts of a carabiner, i.e., a curved relatively stationary member that mates to a spring-loaded arm member that springs inwardly to the carabiner-type connector, but cannot spring outwardly. In an embodiment, a carabiner or carabiner-type connector 150 can be effectively non-removably joined to either of first and second integrated connection members.

In an embodiment, the integrated connection member can be a loop of material, such as relatively flat webbing, as illustrated in FIGS. 32-37. As shown, for example, in the embodiment illustrated in FIGS. 32-34, a first integrated connection member 152 can be a carabiner-type connector, and a second integrated connection member 154 cam be a loop of webbing secured to force sensor 122. The coupling mechanism 107 of a resistance band 106 can be connected to the webbing loop of second integrated connection member 154. In this manner, a resistance band 106 can be joined in a relatively more permanent manner to force sensor 122, while a human interface mechanism 109 can be relatively less permanently secured, and more easily changed via the carabiner-type first integrated connection member 152. As discussed above, in an embodiment, the first and second integrated connection members 152 and 154 can be considered upper and lower connection members, respectively, and can extend upwardly and downwardly, respectively, in alignment with the linear orientation of a resistance band 106, as indicated by axis A1 in FIG. 33. Axis A1 can be in a plane that effectively bisects the first and second connection members, as well as the force sensor front to back. Additionally, first and second connection members 152, 154, can be joined to force sensor 122 such that they align with axis A2, as shown in FIG. 34. Axis A2 can be in alignment with a resistance band 106 joined to force sensor 122, but can be offset, such that axis A2 can lie in a plane that does not effectively bisect force sensor 122. Axis A2 can lie in a plane that is offset from a central plane that bisects force sensor 122 side to side (not shown).

In an embodiment as illustrated in FIGS. 35-37, a first integrated connection member 152 and a second integrated connection member 154 can each be a loop of webbing secured to force sensor 122. In this embodiment, a permanently secured web-connected carabiner-type connector 156 can be joined to first integrated connection member 152. In an embodiment, web-connected carabiner-type connector 156 can have as an integral component an open slot or loop member 158 through with webbing of first connection member 152 can be looped. A similar type web-connected carabiner-type connector 156 can be secured to second connection member 154. In this manner, first and/or second web connection members 152, 154 can be readily attachable to a human interface mechanism or resistance band, as needed.

As discussed above, in the embodiment shown in FIGS. 35-37, the first and second integrated connection members 152 and 154 can be considered upper and lower connection members, respectively, and can extend upwardly and downwardly, respectively, in alignment with the linear orientation of a resistance band 106, as indicated by axis A1 in FIG. 36. Axis A1 can be in a plane that effectively bisects the first and second connection members, as well as the force sensor front to back. Additionally, first and second connection members 152, 154, can be joined to force sensor 122 such that they align with axis A2, as shown in FIG. 37. Axis A2 can be in alignment with a resistance band 106 joined to force sensor 122, but can be offset, such that axis A2 can lie in a plane that does not effectively bisect force sensor 122. Axis A2 can lie in a plane that is offset from a central plane that bisects force sensor 122 side to side.

Figure 38:
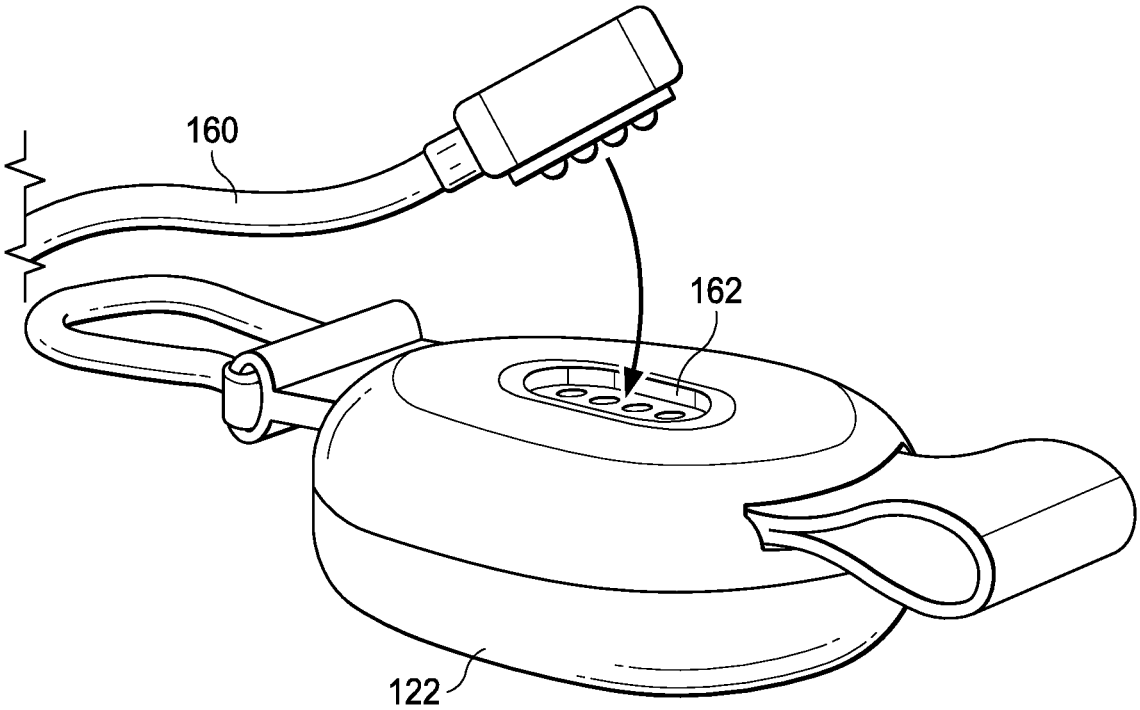
FIG. 38 is a perspective view of an example charging system of a force sensor.
Figure 39:
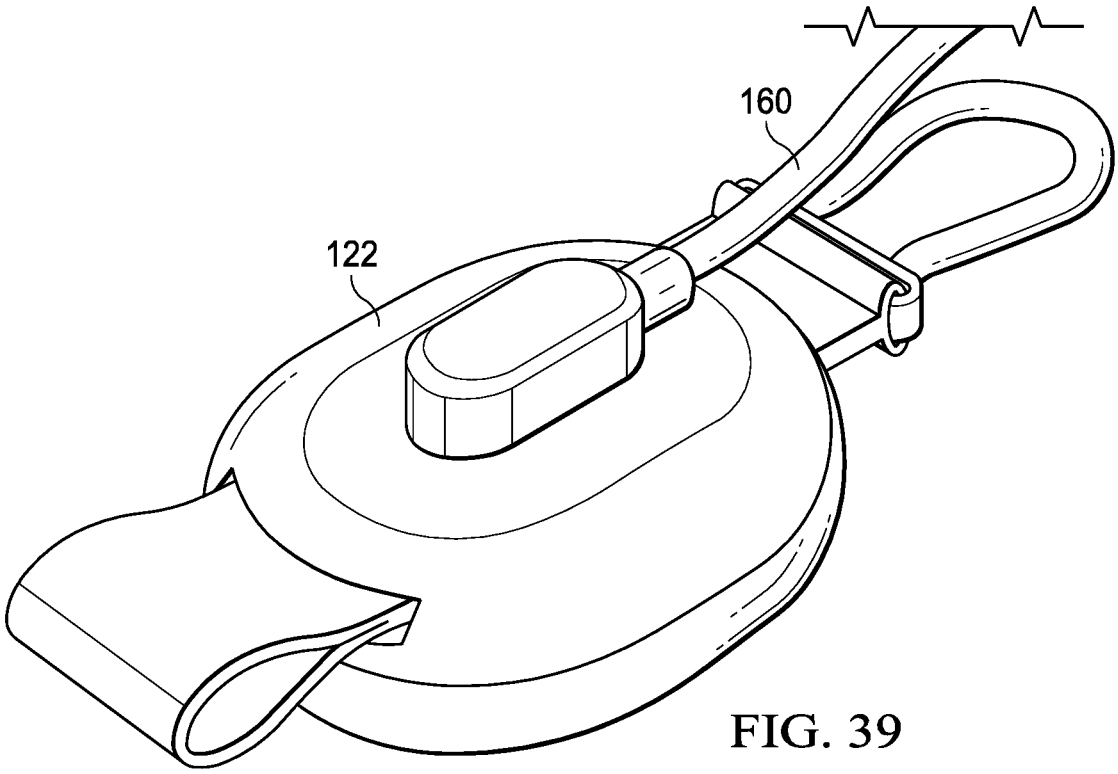
FIG. 39 is a perspective view of an example charging system of a force sensor.

As discussed above with reference to FIG. 24, a force sensor 122 can include a power supply 1223. Power supply 1223 can be a one or more cells in which chemical energy is converted into electricity, e.g., a battery. In an embodiment, power supply 1223 is a rechargeable battery. In an embodiment, the rechargeable battery is removable and rechargeable in a recharge unit. In an embodiment, as depicted in FIGS. 38 and 39, a battery can be recharged by being connected to a recharging cable 160. Recharging cable can be adapted to be inserted into a recharge port 162, for example, by being moved in the direction of the arrow in FIG. 38 such that a sufficient electrical connection is made between the cable 160 and the recharge port 162, which can be located on the back of a force sensor 122, as shown in FIGS. 38 and 38. In an embodiment, the recharge technology is USB C and the recharge cable is a USB Type-C, 24-pin USB connector system, which is distinguished by its two-fold rotationally-symmetrical connector. In an embodiment, the recharge cable 160 can be magnetically engaged with the recharge port 162. In an embodiment, the recharge cable 160 can be connected to recharge port 162 while the force sensor 122 is in use in the system 200.

Figure 40:
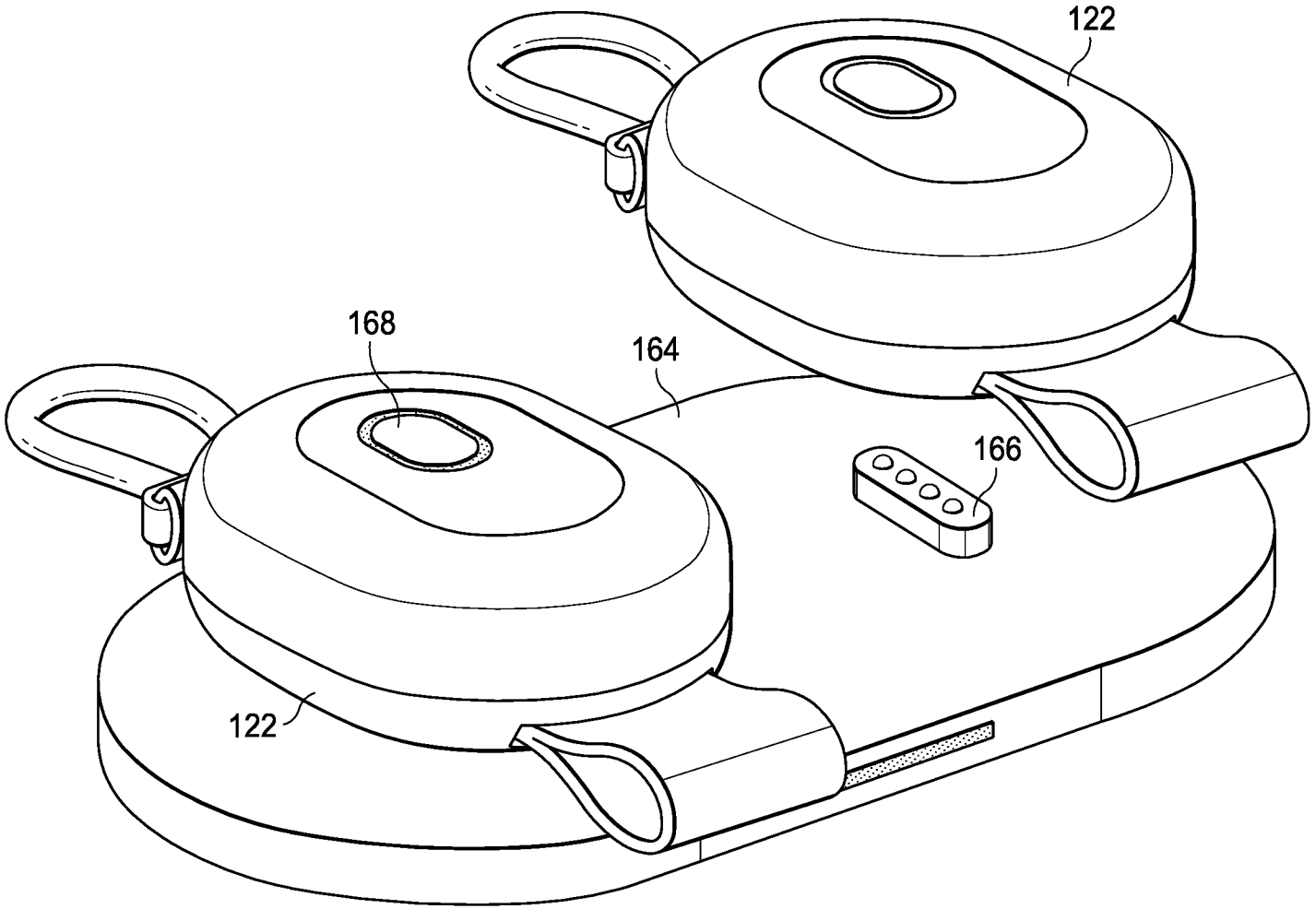
FIG. 40 is a perspective view of an example charging system of a force sensor.

Referring now to FIG. 40, in an embodiment, batteries of force sensors 122 can be recharged by being electrically connected to a relatively stationary charging station 164. Charging station 164 can have one or more integrated charging nodes 166 that can mate with the recharge ports 162 of force sensors 122. An indicator, such as an indicator light 168 can indicate when a charge is complete. Indicator light 168 can be located anywhere on force sensor 122, and in an embodiment, is on the front of the force sensor, as depicted in FIG. 40.

While various aspects and embodiments have been disclosed herein, other aspects and embodiments will be apparent to those skilled in the art. The various aspects and embodiments disclosed herein are for purposes of illustration and are not intended to be limiting.

Referring now to FIGS. 41-52 there is shown additional embodiments of a portable strength training apparatus 100. The embodiments shown in FIGS. 41-52 can have all the features of the embodiments described above, including a platform base 101 having a top surface 1011, a bottom surface 1012, and a plurality of base attachment mechanisms 103, wherein one or more of the plurality of base attachment mechanisms 103 may be removably coupled with a resistance band 106, and can incorporate force sensors 122 (as described above). As well, the embodiments shown in FIGS. 41-52 can have a hinge 104, as described above, to allow the platform base 101 to fold over on to itself for easier transportation. The portable strength training apparatus 100 may have a handle (as described above, not shown), such as hand holds, again for easier transportation.

Figure 41:
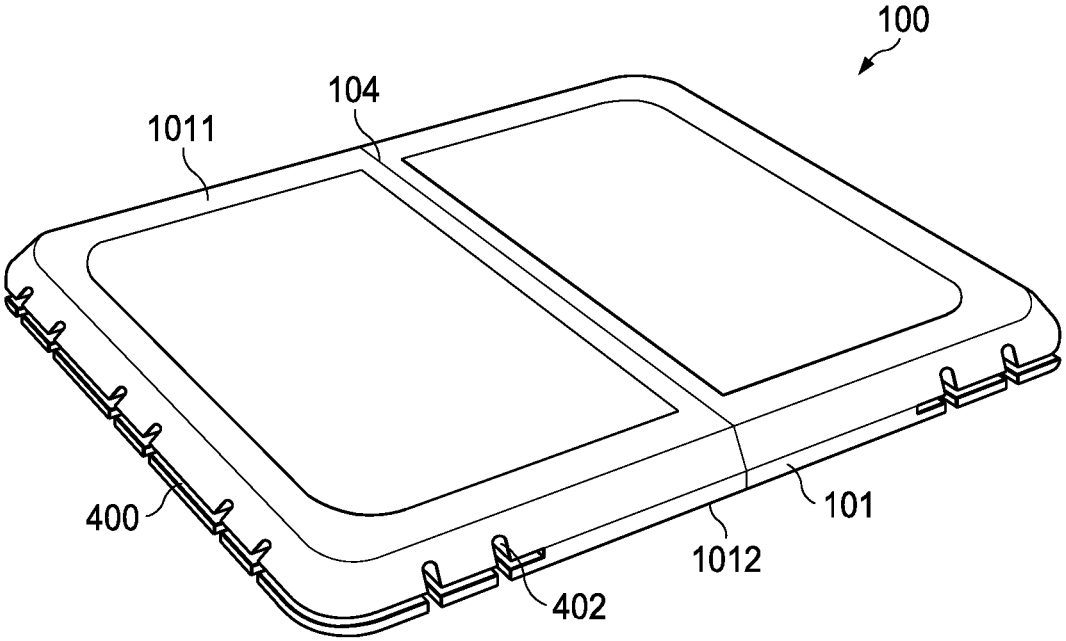
FIG. 41 is a perspective view of a portion of an example portable strength training apparatus.
Figure 42:
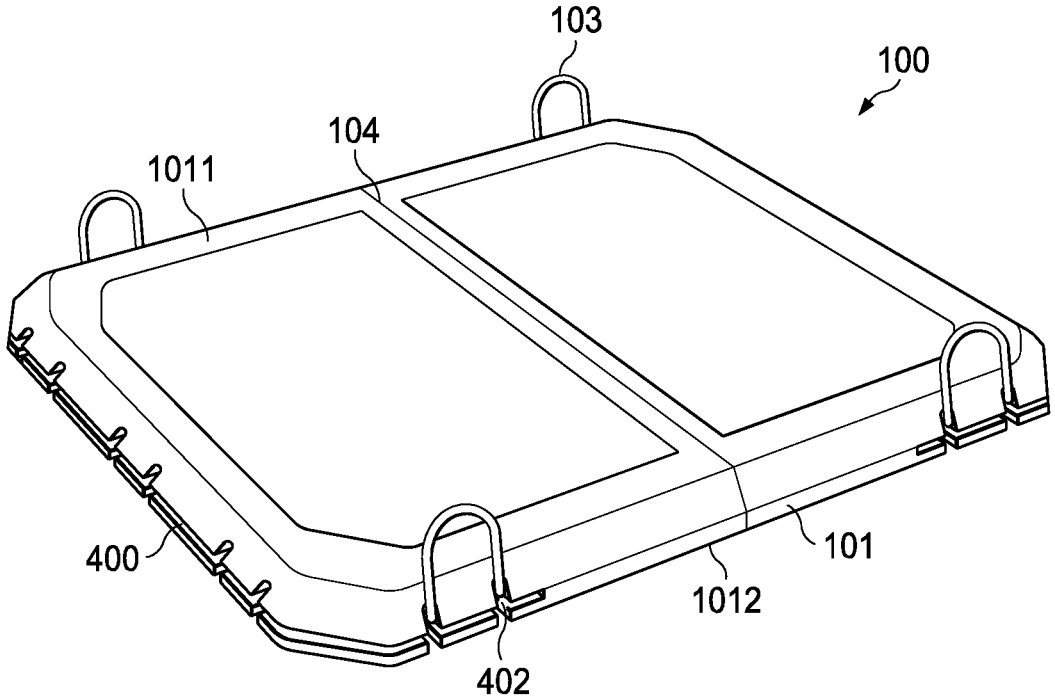
FIG. 42 is a perspective view of a portion of an example portable strength training apparatus.
Figure 43:
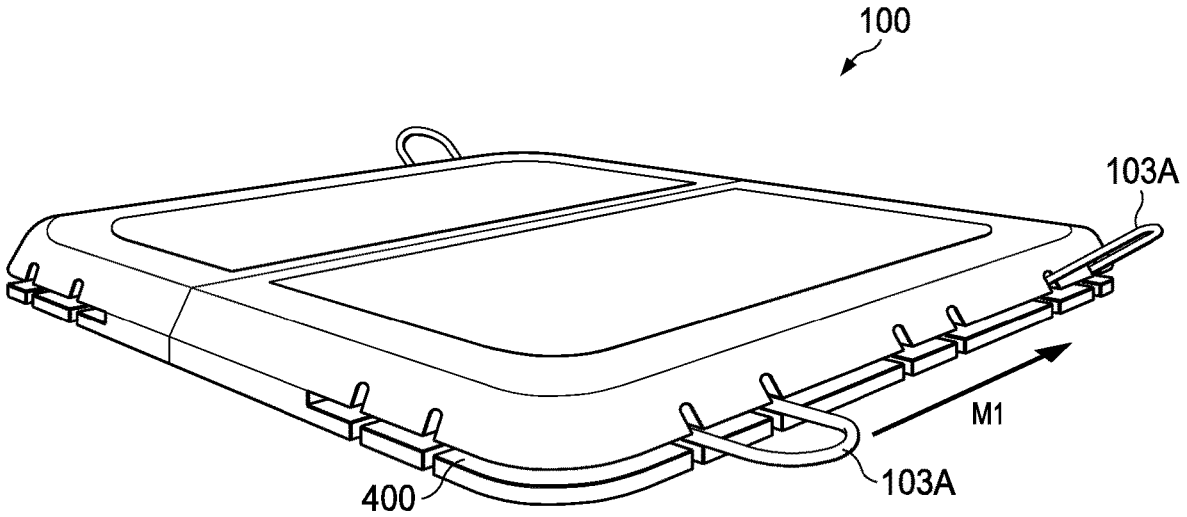
FIG. 43 is a perspective view of a portion of an example portable strength training apparatus.
Figure 44:
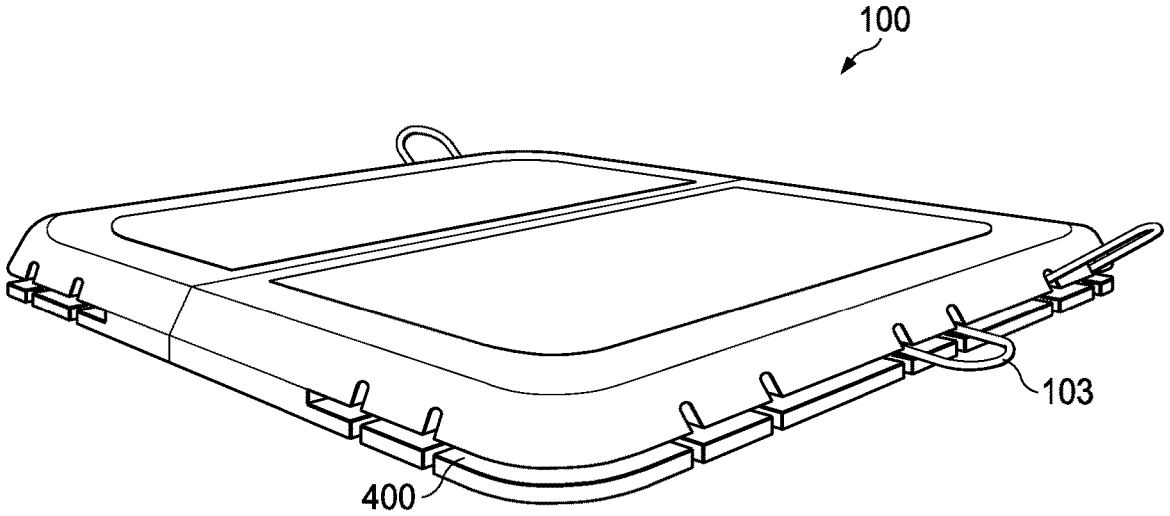
FIG. 44 is a perspective view of a portion of an example portable strength training apparatus.
Figure 45:
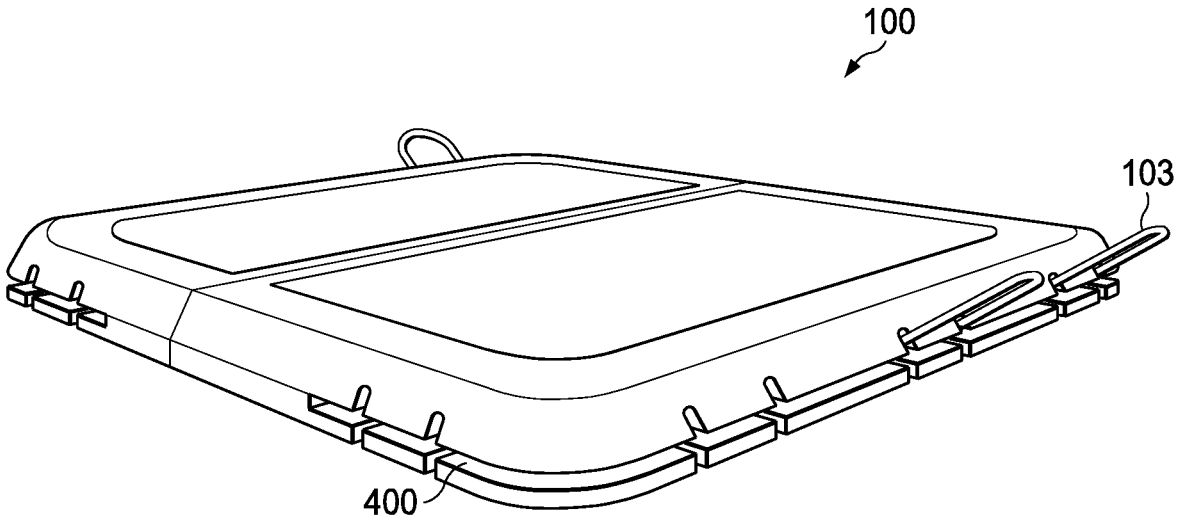
FIG. 45 is a perspective view of a portion of an example portable strength training apparatus.

In contrast to the embodiments described herein above, the embodiments shown in FIGS. 41-52 comprise a structure and system facilitating moveable base attachment mechanisms 103, which otherwise function as described above to couple a resistance band 106. For example, as shown in FIGS. 41-52, the platform base 101 can comprise a peripheral groove 400 disposed about at least a portion of the periphery of the platform base 101, the peripheral groove 400 facilitating the sliding movement of a base attachment mechanism, for example as shown in FIG. 43 which illustrates a base attachment mechanism 103A partially disposed within and moving along the periphery in the direction of arrows M1 to a different position. The peripheral groove 400, therefore, permits substantially infinite peripheral positional locations for attachment mechanisms 103 about the periphery of the platform base 101.

Figure 50:
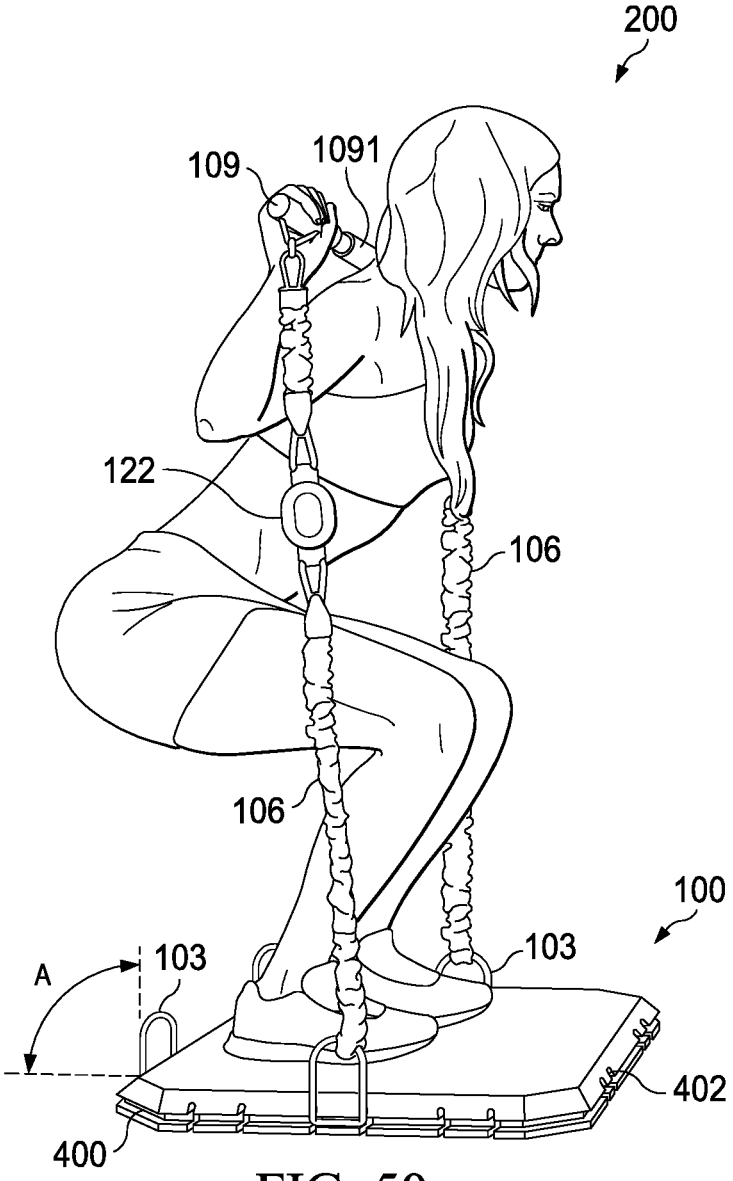
FIG. 50 is a perspective view of a portion of an example portable strength training system.

The peripheral groove(s) 400 of portable strength training apparatus 100 can have extending therefrom in a spaced relationship one or more locking grooves 402, which extend generally orthogonally from the peripheral groove 400 toward, and in an embodiment, to, the first surface 1011. For example, as shown in FIGS. 41 and 42, a plurality of locking grooves 402 extend from peripheral groove 400 toward and to the first surface 1011, such that corresponding base attachment mechanisms 103 can be urged in a pivoting manner into the locking grooves in a substantially vertical position, i.e., orthogonally vertical with respect to the top surface 1011, as depicted in FIG. 50 in which an angle A is shown, with the angle being substantially 90 degrees. In an embodiment, the locking groove 402 can extend further into the top surface 1011 such that the angle A can be less than 90 degrees with respect to the top surface 1011. Once pivotally urged into the locking grooves, an attachment mechanism 103 is "locked" into a location for use with a resistance band, as described herein above.

As can be understood, the number, placement, and location of locking grooves 402 can be varied and predetermined to provide for a desired placement of attachment mechanisms during a workout. The placement of the attachment mechanisms 103 can be readily and easily changed by simple folding them down, sliding to a new location, and folding them up into a different set of locking grooves. As can be understood, in an embodiment, the locking grooves can be in pairs corresponding to, and mating with, two extending portions of the attachment mechanism 103, as shown in FIGS. 41-52. However, in embodiments, the number and placing of locking grooves can be different, depending on the shape, style, and size of attachment mechanisms 103. For example, attachment mechanism can be substantially "T" shaped or "H" shaped, and function substantially like a cleat, as described above, in which a single locking groove 402 can facilitate the folding movement of the attachment mechanism 103.

Figure 49:
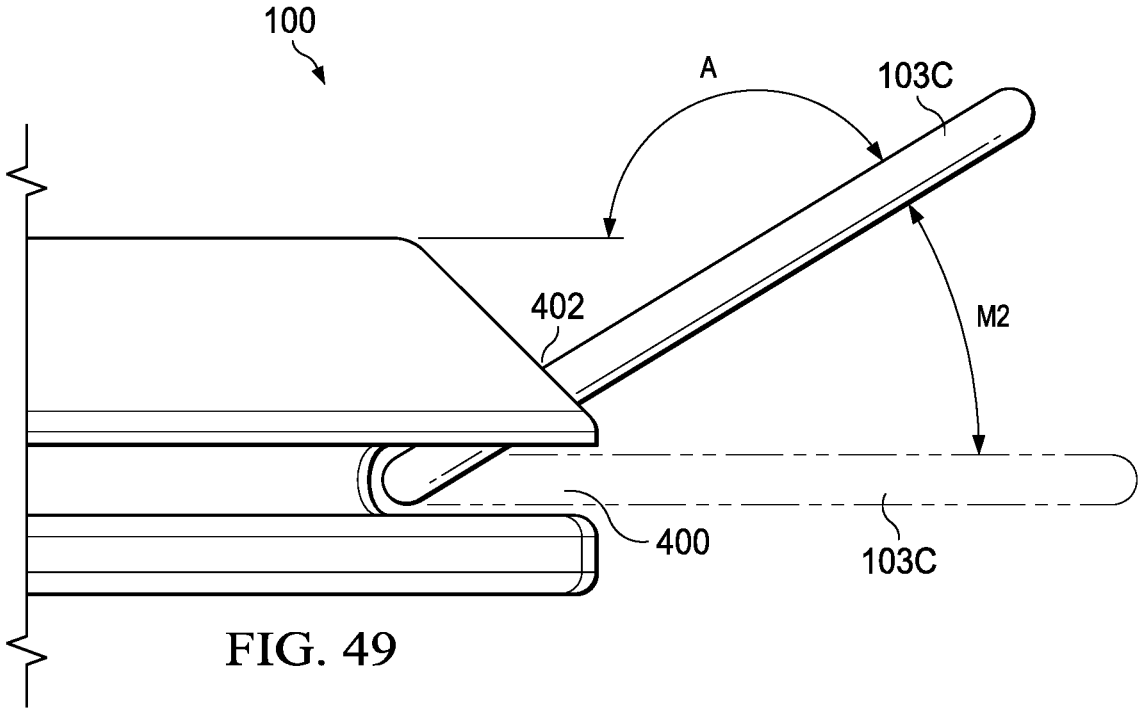
FIG. 49 is a side elevation view of a portion of an example portable strength training apparatus.

In an embodiment, as shown in FIGS. 43-49, locking grooves can extend a distance short of the top surface 1011 such that when the attachment mechanism is pivoted in an upward position it is not substantially orthogonal to the top surface 1011 but extends at an angle A of greater than 90 degrees with respect to the top surface 1011. As shown in FIG. 49, for example, an attachment mechanism 103C can be pivoted at a pivot location inside peripheral groove 400 from a first position shown in dashed line in the direction of arrow M2 to a second position, the second position being an in-use position with the attachment mechanism being positioned in at least one locking groove 402.

Figure 46:
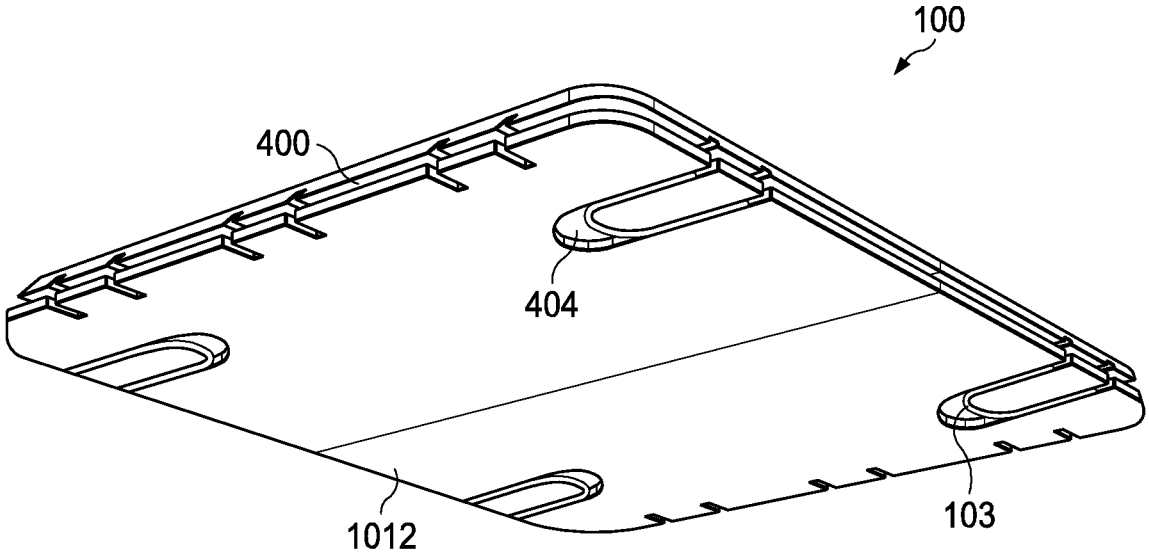
FIG. 46 is a perspective view of a portion of an example portable strength training apparatus.
Figure 47:
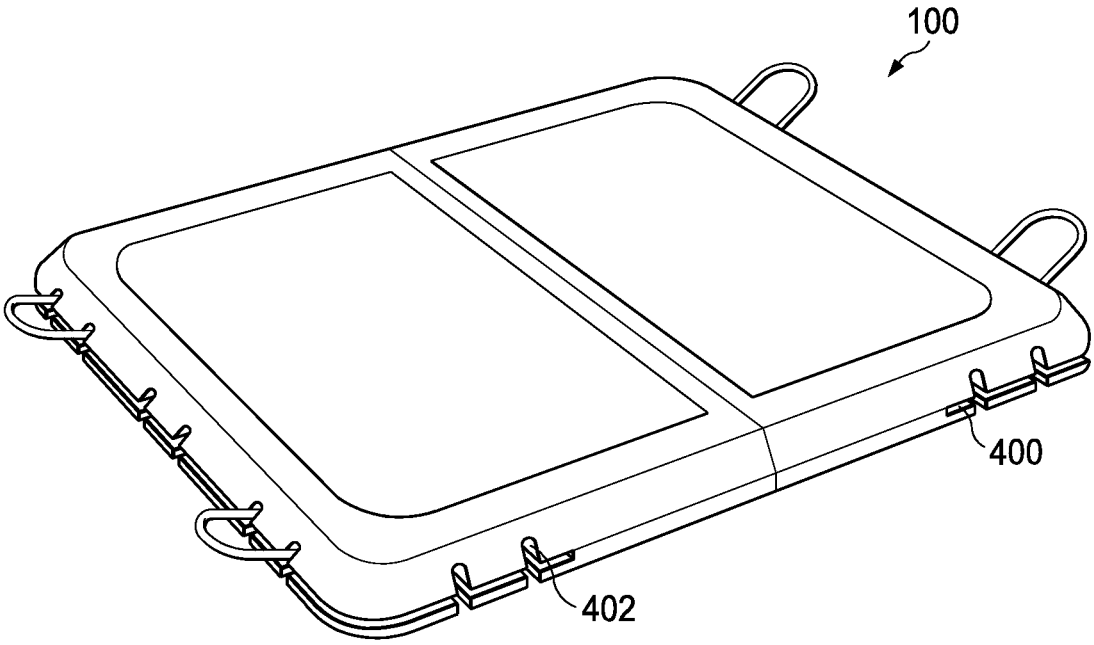
FIG. 47 is a perspective view of a portion of an example portable strength training apparatus.
Figure 48:
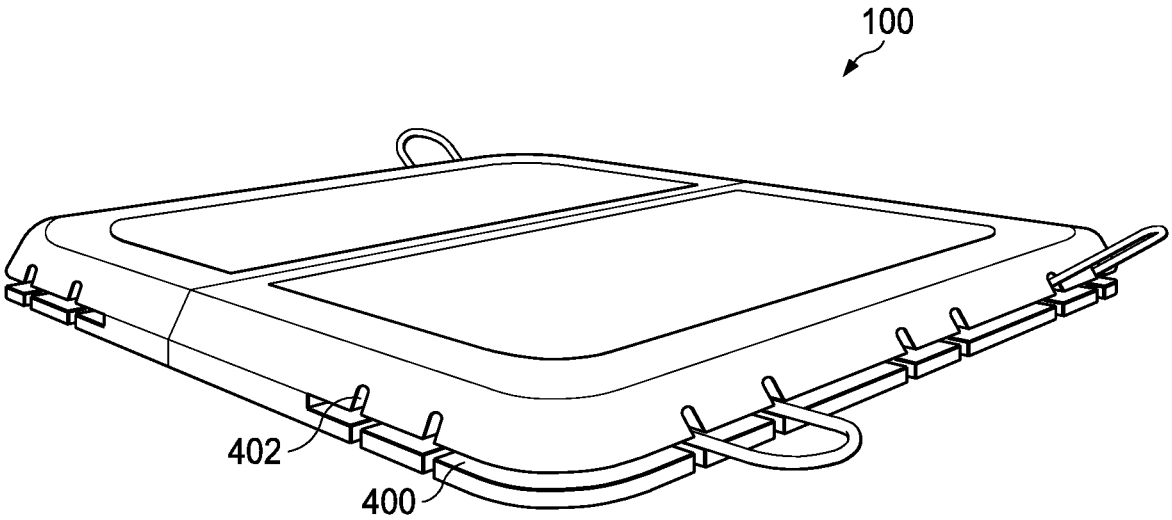
FIG. 48 is a perspective view of a portion of an example portable strength training apparatus.

Further, as shown in FIG. 46, in an embodiment storage grooves 404 can extend from peripheral groove 400 to the bottom surface 1012, such that attachment mechanisms 103 can be folded down and into the storage grooves 404 when they are not being used. In an embodiment, the attachment mechanisms 103 can be positioned fully within storage grooves 404 such that when stored, the attachment mechanisms 103 to not extend beyond the bottom surface 1012, as shown in FIG. 46. In an embodiment, storage grooves can be on the top surface 1011, in which case the locking grooves can extend further onto top surface 1011 such that an attachment mechanism can be fully pivoted into the top surface 1011 in the same manner as depicted for the bottom surface in FIG. 46.

Figure 51:
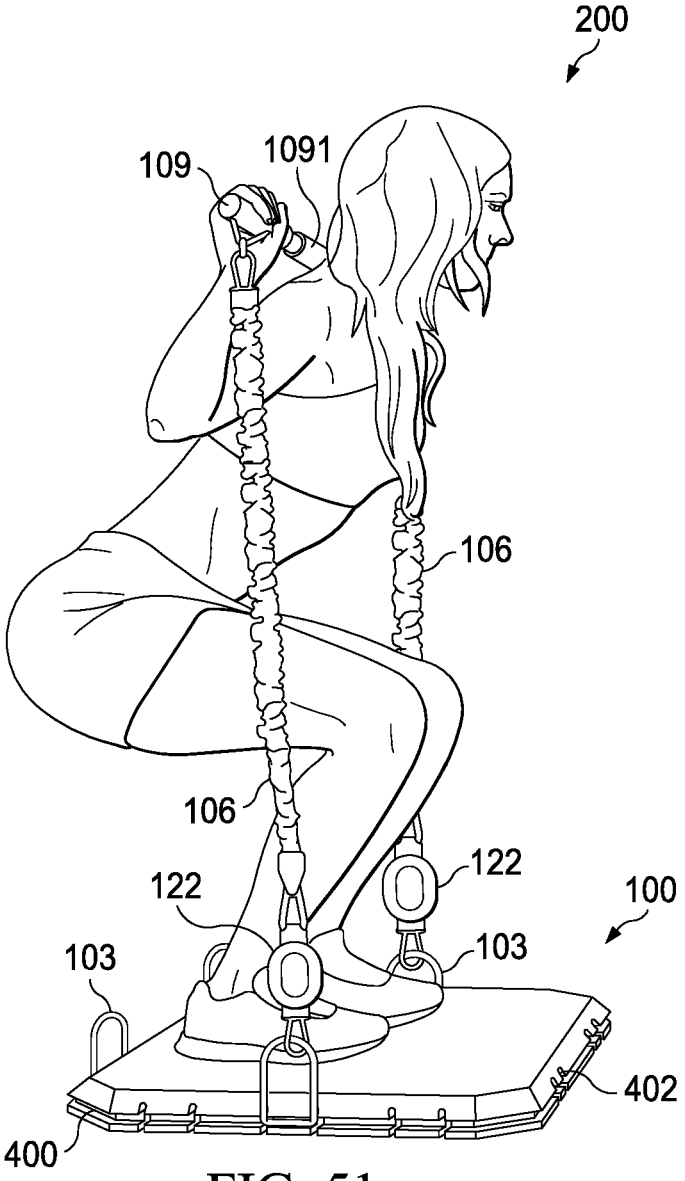
FIG. 51 is a perspective view of a portion of an example portable strength training system.
Figure 52:
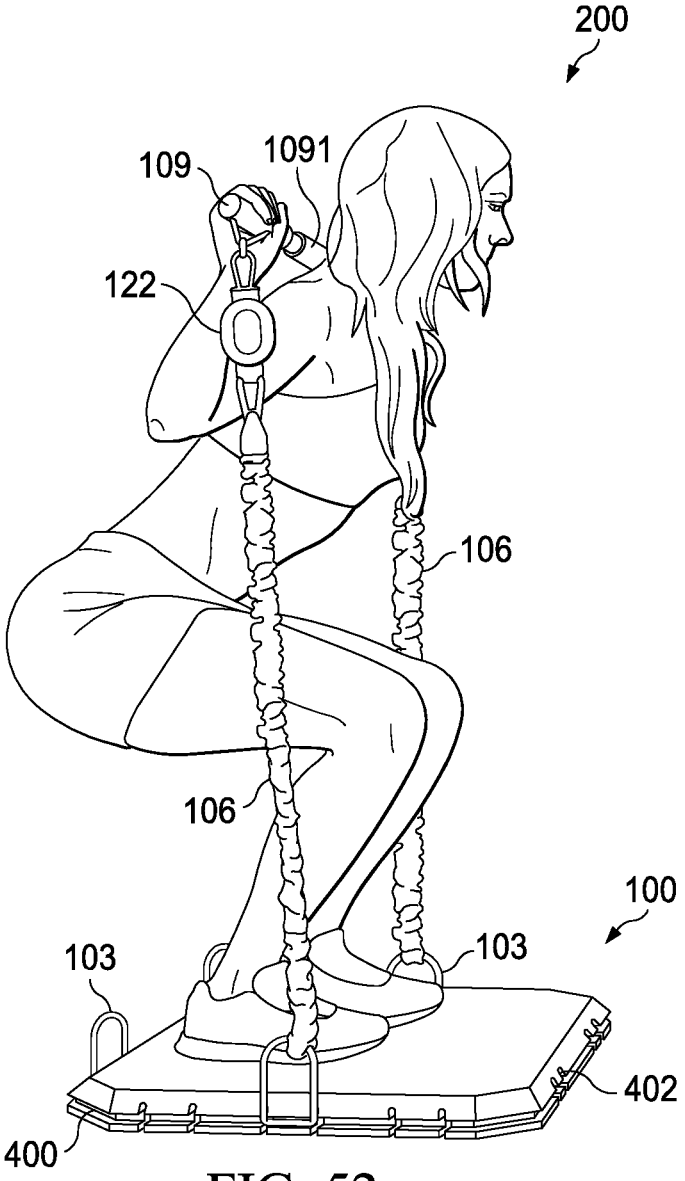
FIG. 52 is a perspective view of a portion of an example portable strength training system.

As shown in FIGS. 50-52, adjustable attachment mechanisms as described herein can be used in a system 200 which includes the use of force sensors 122, which, as described herein, can be in communication with external devices such as smartphones, including the devices of third parties. As shown in FIG. 50, a force sensor 122 can be coupled to a resistance band 106. As shown in FIG. 51, a force sensor 122 can be disposed at the coupling location of the resistance band to the attachment mechanism 103. As shown in FIG. 52, the force sensor 122 can be coupled to, or incorporated in, the human interface mechanism 109, such as a workout bar 1091.

In an embodiment, a system 200 of the present disclosure can include multiple computing devices in operative communication such that a user, e.g., a person exercising, a trainer, and/or one or more third party businesses, e.g., an employer, a doctor, and insurance company, or a friend, can share data. Operable communication can be, for example, via an internet connection, via a SaaS configuration, or via wired connection. For example, as discussed above with respect to FIGS. 25 and 26, exercise (e.g., force, rep, set, calories) data from sensors 122 can be displayed to a client 2002 on an operatively connected I/O device, such as a smartphone. In addition to the smartphone of the client receiving, and/or processing, the force data, other computing devices, such as networked computers of trainers 2122 and third parties 2126 can display data, aggregated data, averaged data, total data, and the like, to assess progress, or the lack thereof, of a client, as discussed more fully below with respect to FIG. 59.

Figure 53:
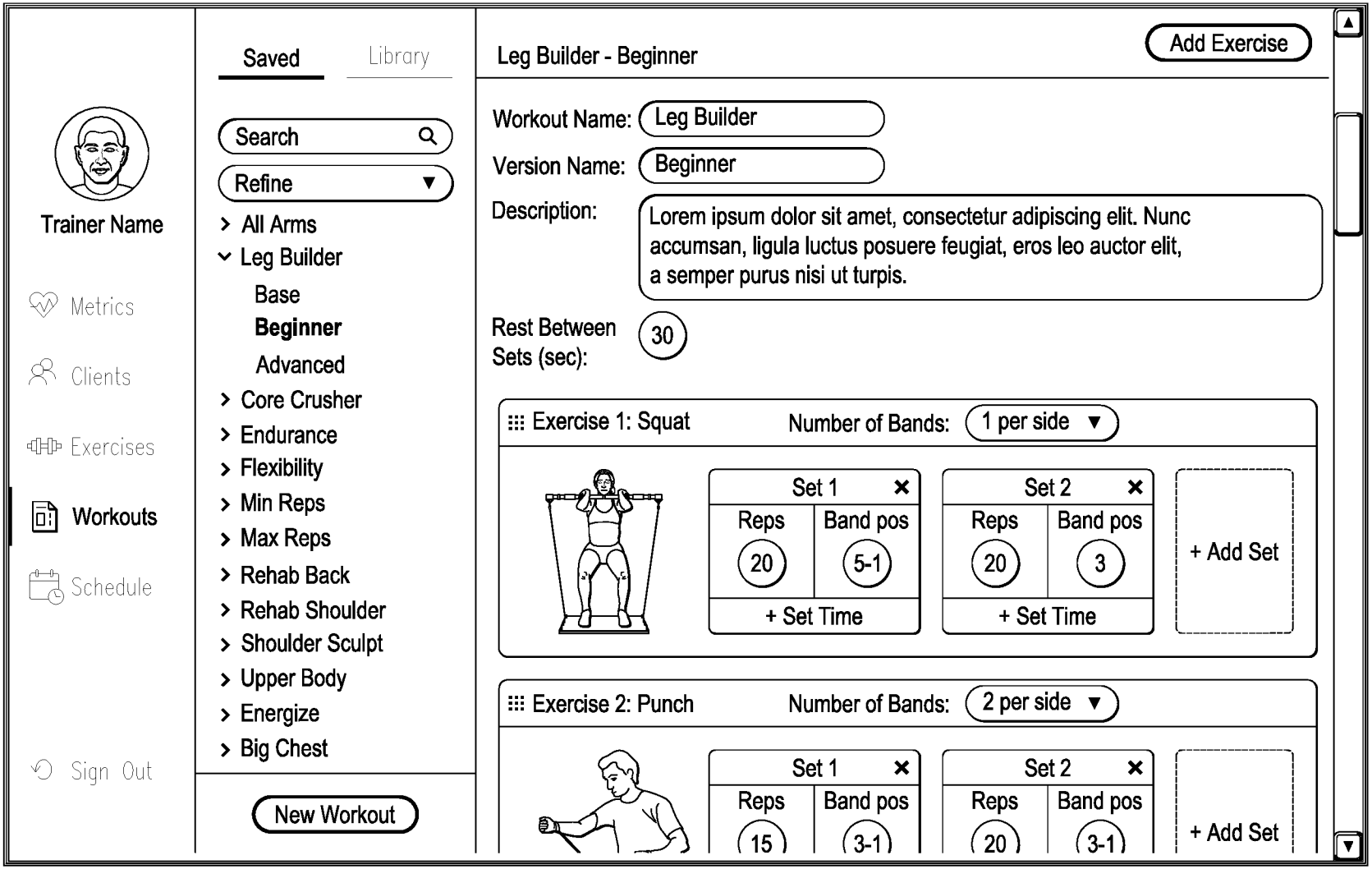
FIG. 53 is an example screen display of a client interface.
Figure 54:
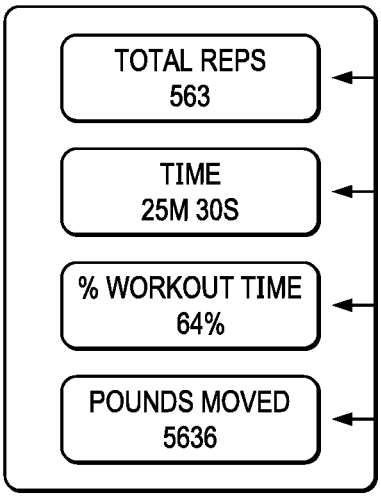
FIG. 54 is an example screen display of a client smartphone app.

By way of example, a sample screen shot of a client interface, such as can be displayed on a smartphone I/O device 2004, is shown in FIG. 53. As discussed above, and more fully here, an individual client can have recorded and visualized various workouts, exercises, number of reps (individual repetitions of an exercise), number of sets (a series of repeated reps in a span of time), and/or total force (e.g., weight) resistance experienced. A representative screen shot of a client smartphone app summary is shown in FIG. 54, showing, for example, total reps, the total workout time, the percent of time working out (e.g., vs. resting time), and the total pounds moved (e.g., total force registered by the sensor 122, or sum of peak forces experienced by the sensor).

Figure 55:
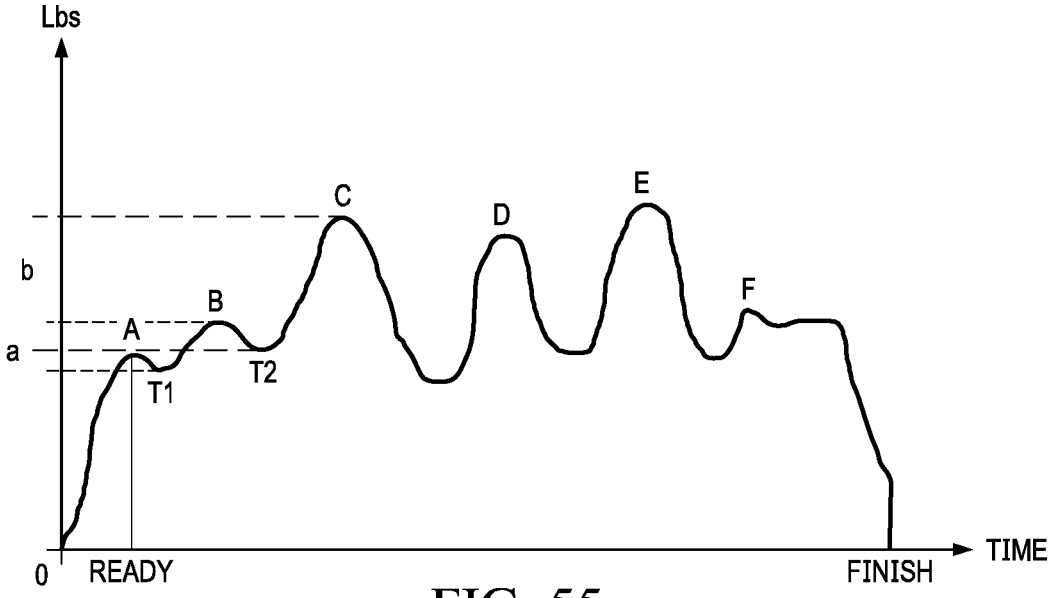
FIG. 55 is a representative graph showing peak force values received from a force sensor over time.
Figure 56:
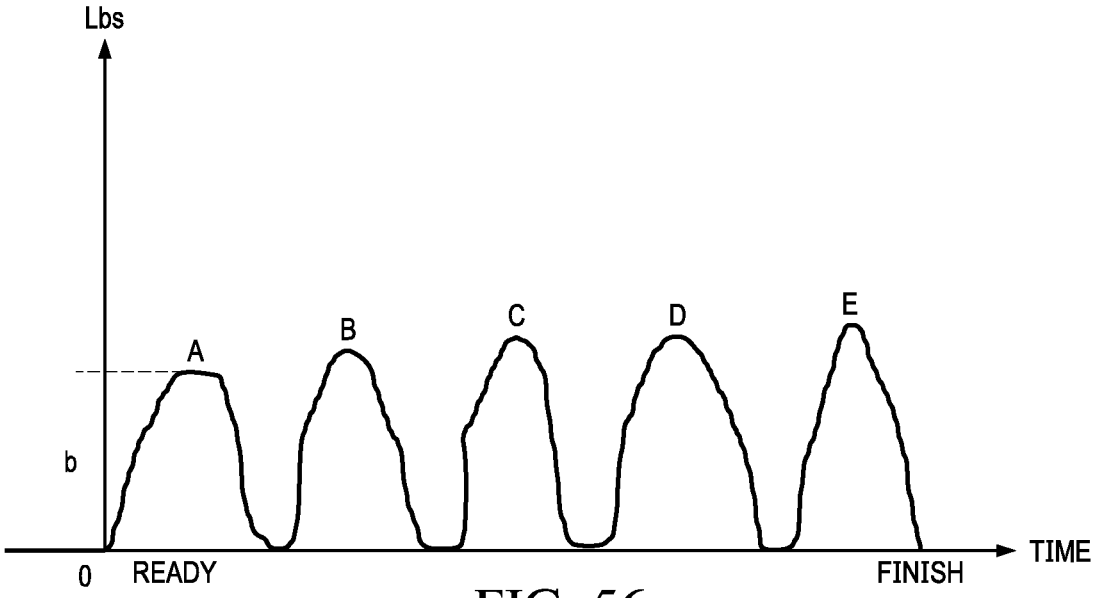
FIG. 56 is a representative graph showing peak force values received from a force sensor over time.
Figure 57:
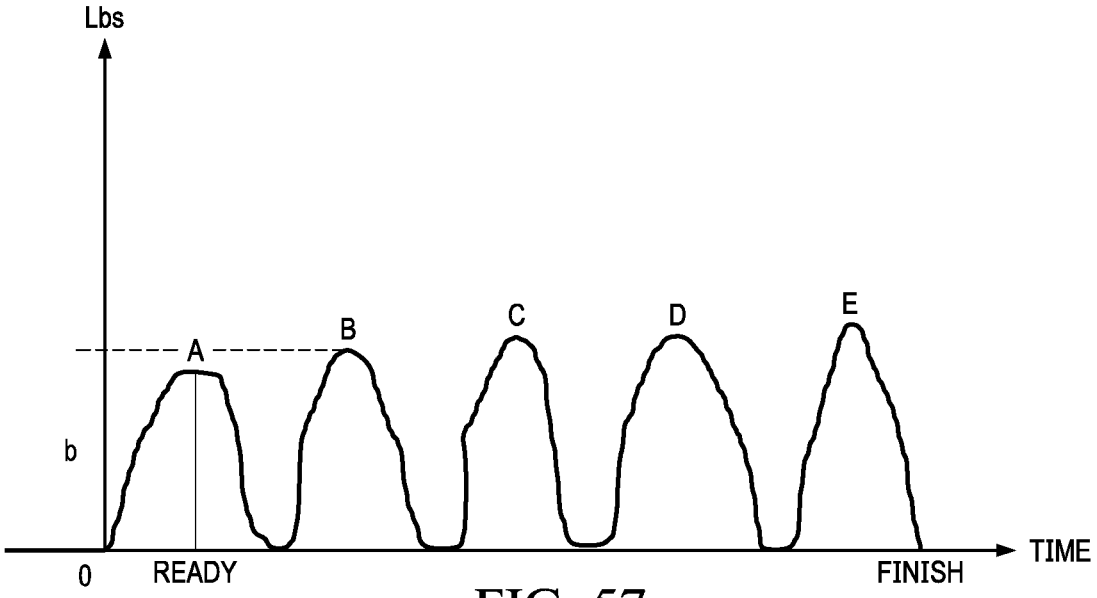
FIG. 57 is a representative graph showing peak force values received from a force sensor over time.

With respect to total pounds moved, the system 200 can utilize one of several algorithms to approximate an accurate measure of force, average force, and/or total force, and each can be visualized with respect to the three representative graphs of FIGS. 55-57, in which individual prospective reps (measured, recorded, and/or reported peak force measures) are shown as peaks A-F progressing from Time=0 to a finish time.

In one representative set of reps shown in FIG. 55, a user can produce a first and second maximum force response of the sensor at A and B that is not actually a considered by the algorithm as a valid rep. In this algorithm, the first and second peak forces measured at A and B are considered adjustment peak forces, in which the user is getting adjusted for an actual valid rep, which occurs first at C. Because the force difference between peak A and peak B (the difference being represented by the distance "a") is relatively low, and the difference between force peak B and force peak C (the difference being represented by the distance "b") is relatively high (and relatively consistent with peaks D and E), in an algorithm the first one or two peaks (e.g., A and B), and possibly a final peak (e.g., peak F) are not counted in the number of reps and/or the number of total pounds moved. That is, in an embodiment, the rep counting and force totaling algorithm will count only the highest peak forces, and/or the highest, relatively consistent peak forces in the rep/force count. In an embodiment, the algorithm discards force data that shows a force measurement less than 10%, or 20%, or 30% that of an average peak force data. In an embodiment, the algorithm can report data with respect to N peaks, where N is a positive integer and equals the number of force peaks within 70%, or 80%, or 90%, of one another or an average of all the peaks. In an embodiment, the algorithm can build in a delay, which can be adjusted and set by the user, which ignores force data until a preset time, and thus produces a series of force peaks all of which can be counted toward a valid rep total, much as discussed below with respect to FIG. 56.

In one representative set of reps shown in FIG. 56, a user produce a series of reps A-E in which each one is relatively consistent in peak force. That is, the data from sensor 122 shows N peaks, where N is a positive integer and equals all of force peaks in the set, and all the force peaks are within 70%, or 80%, or 90%, of one another. In this embodiment, the valid rep counting and force totaling algorithm can count all the peak forces in the number of valid reps and/or the number of total pounds moved.

In another embodiment, the number of reps in a set can be more accurately determined based on the type of exercise being performed. For example, for squats, the first force peak, shown as peak A of FIG. 57, can occur due simply to standing up preparing to do a full squat or a series of squats. Thus, in an embodiment, the algorithm can be exercise-dependent, and can, for example, discard certain peaks from the recorded data based on the particular movements associated with the exercise.

Figure 58:
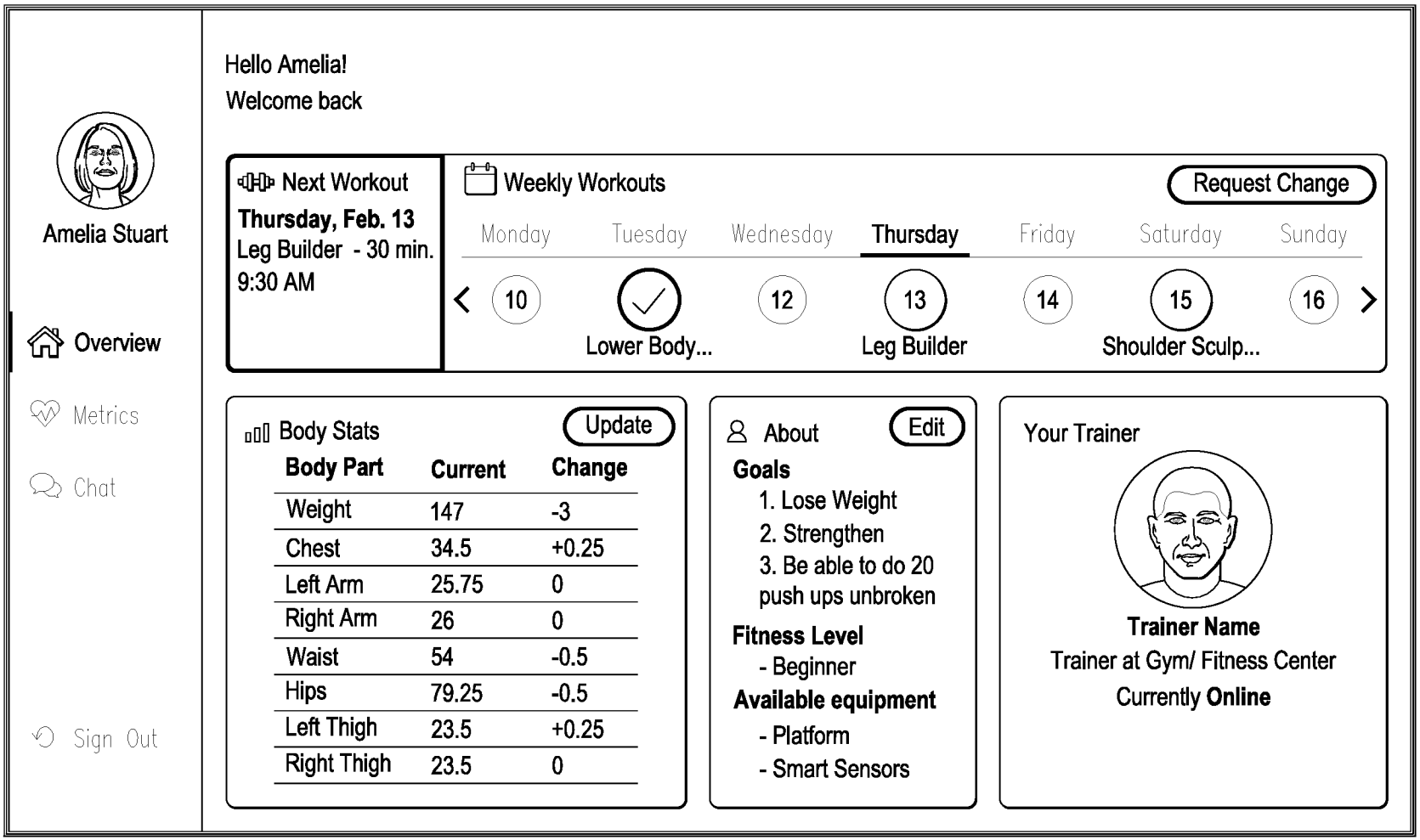
FIG. 58 is an example screen display of a training provider.

Once data is processed, and, for example, transmitted to a client, the data can be shared with a training provider 2122, which can be the service provider operating the administrative component 2112. Data can be displayed on a training dashboard 2124, an example of which is depicted in FIG. 58. The training dashboard can track, display, analyze, and record various information related to a particular trainer's clients, including clients names, scheduled workouts, completed workouts, missed workouts, and messages.

Figure 59:
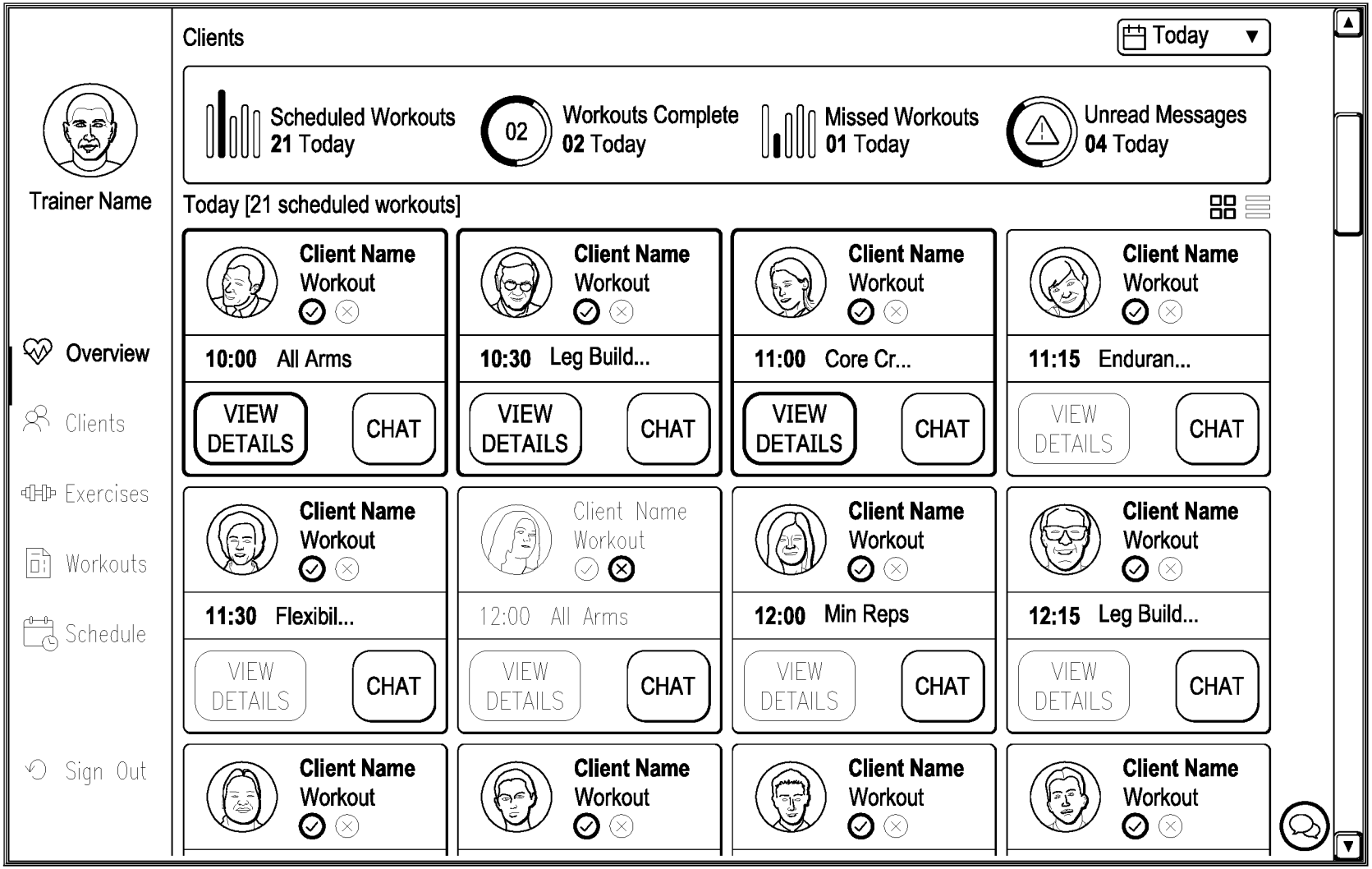
FIG. 59 is an example screen display of a third party.

In an embodiment, information transmitted to a client I/O device 2004 can also be shared in a like manner with a third party 2126, such as an employer engaging in an employee fitness program. Information can be displayed on a third party dashboard 2128, as shown in FIG. 59. An employee of a business client can have information shared with the business client, including weekly workouts, goals, fitness level, available equipment, trainer information, dates and times.

Figure 60:
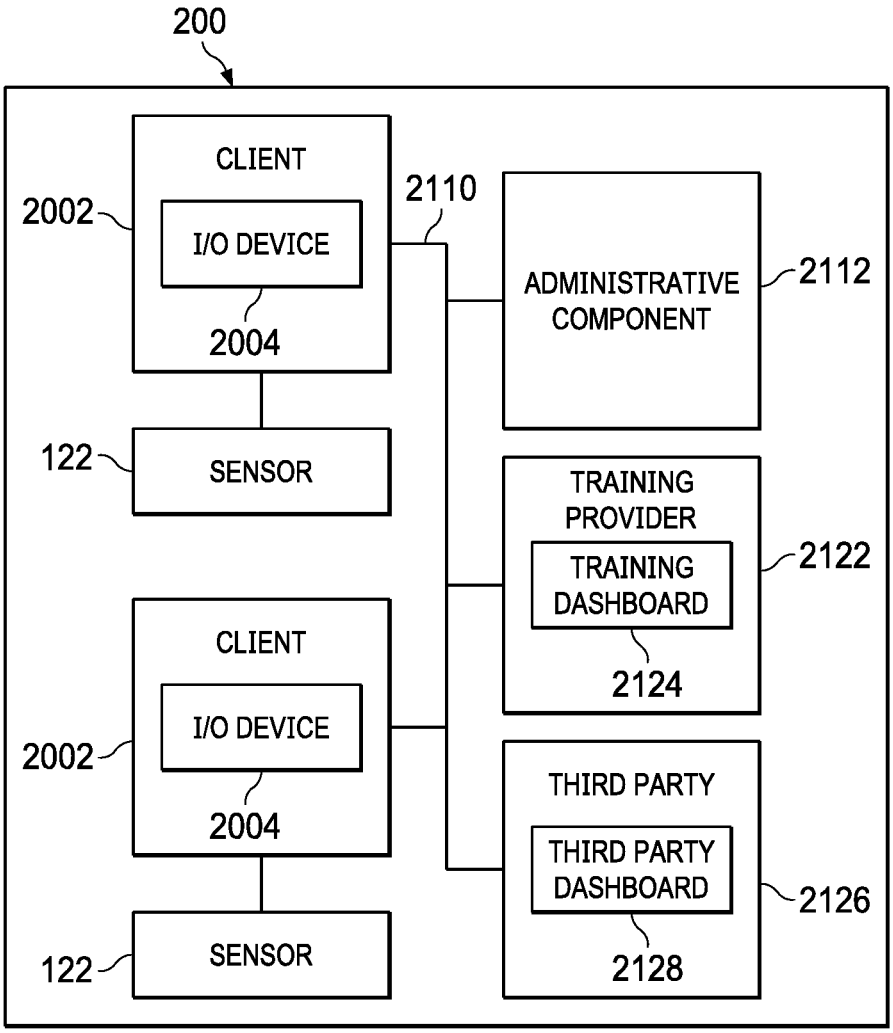
FIG. 60 is a representative schematic representation of an embodiment of a system of the present disclosure.

As depicted schematically in FIG. 60, any operatively connected devices associated with a system 200 of the present disclosure can be connected to an administrative component 2112, which can comprise an administrative component server. An administrative component can comprise an administrative computer system for implementing and operating administrative system software that can perform a method of the disclosure and which can be operated by a system administrator. The administrative computer system can be electrically linked to at least one system server used to access and retrieve information with respect to the network system 2110, which can be the internet, a cloud system, cloud computing, or the like. The administrative computer system can include a processor for operating the administrative software system and a memory that can be non-transitory computer-readable media, and that can be electronically coupled to other devices, such as an input device, like a keypad, touch screen, or any other suitable input device that can accept and store information, and one or more suitable output devices, such as a computer display, printer, and the like. Memory can include database modules, including a customer database. It should be understood that the administrative computer system can include any combination of the above components, or any number of different components, peripherals, and other devices. The administrative computer system can operate under the control of an operating system, such as the WINDOWS operating system developed by Microsoft Corporation or the MACINTOSH operating system developed by Apple Computer Corporation. It should be understood, however, that other operating systems could be utilized to implement the administrative system software of the system 200 of the present disclosure. In general, the system 200 can operate on the internet via conventional HTML web browser technology, utilizing web pages, hyperlinks, windows, URLs, email, cloud computing, and the like, as is known in the art.

In an embodiment, therefore, a system of the present disclosure can comprise a server based network of computing devices, including at least one client 2002 operating a client device 2004 device operatively coupled, such as by Bluetooth®, to a sensor 122. The operative coupling can include receiving from the sensor 122 data processed by the force sensing module 1225, the data being reported to the client device as reps, sets, and pounds related to force measurements. In an embodiment, at least one other device, for example, a device of the system training provider 2122 or a third party 2126 can also receive, for example by internet connection 2110 from the client device, information derived from the sensor 122.

In an embodiment, the information from the sensor 122 comprises information processed by an algorithm that averages sequential peak values of force (i.e, potential reps) in a time bounded by a start time of the first peak and an end time at least two seconds after the last peak (i.e., a set). In an embodiment, the algorithm considers a peak as a rep only if the peak is within 10%, or 20%, or 30 percent of an average of all the peaks. In an embodiment, if a peak that is less than 10%, or 20%, or 30% of an average of all the peaks is discarded from the data reporting reps (i.e., it is not considered a rep). In an embodiment, the report of reps, sets, total weight, time, date, and the like can be visualized on the client device, the system server, or the third party device.

Various modifications of the above described grooves and attachment mechanisms can be incorporated. For example, peripheral groove 400 can comprise bearings, such as linear slide bearings or Teflon-type coatings to facilitate smooth operation. Further, attachment mechanisms 103 can comprise generally flexible materials, such as flexible polymers that facilitate ease of movement around peripheral corners of the platform base.

The sections above may set forth one or more but not all exemplary embodiments and thus are not intended to limit the scope of the present disclosure and the appended claims in any way. Embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptation and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Following from the above description summaries, it should be apparent to those of ordinary skill in the art that, while the methods, apparatuses and data structures herein described constitute exemplary embodiments of the current disclosure, it is to be understood that the embodiments contained herein are not limited to the above precise embodiments and that changes may be made without departing from the scope as claimed.

What is claimed is:

1. A portable strength training apparatus, comprising:

a. a platform base having a top surface, a bottom surface, a periphery extending between the top surface and the bottom surface, a peripheral groove and a locking groove that extends into the periphery from the peripheral groove, and an attachment mechanism slideably disposed in the peripheral groove, wherein the attachment mechanism is pivotally moveable into the locking groove;

b. a resistance band having a first end and a second end, the resistance band being coupled at the first end to the attachment mechanism;

c. a human interface mechanism coupled to the resistance band; and d. a force sensor removably coupled to the second end of the resistance band, the force sensor comprising a force transducer comprising electronic circuitry to measure cyclic resistance force values applied to the resistance band.

2. The portable strength training apparatus of claim 1, wherein the force sensor is physically coupled to the resistance band and converts an input mechanical force into an electrical output signal.

3. The portable strength training apparatus of claim 1, wherein the force sensor is configured to transmit force values in the resistance band to an external device.

4. The portable strength training apparatus of claim 1, wherein the force sensor comprises an application processor and is programmed to transmit cyclic force value data on a regular time interval after a minimal threshold force is detected.

5. The portable strength training apparatus of claim 1, wherein the force sensor comprises an application processor and is programmed to transmit information relating to a strength training session selected from the group consisting of: force measured at any moment, force total per the session, time of the session, and combinations thereof.

6. The portable strength training apparatus of claim 1, wherein the force sensor is configured to transmit information from the force sensor to third party device.

7. The portable strength training apparatus of claim 1, wherein the force sensor comprises a power supply comprising a rechargeable battery, and wherein the force sensor further comprises a charging port.

8. A portable strength training system, comprising:

a. the portable strength training apparatus of claim 1; and b. a wireless transceiver module comprising a wireless transmission antenna for wireless transmission of the cyclic resistance force values.

9. The portable strength training system of claim 8, the system further comprising a smartphone, the smartphone being paired to the force transducer via the wireless transceiver module.

10. The portable strength training system of claim 8, wherein the force sensor comprises a power supply comprising a rechargeable battery and a charging port, and wherein the system comprises a recharge cable compatible with the charging port.

11. The portable strength training system of claim 8, wherein the force sensor is configured to transmit information from the force sensor to third party device.

12. The portable strength training system of claim 8, wherein the force sensor comprises an application processor and is programmed to transmit cyclic force value data on a regular time interval after a minimal threshold force is detected.

13. The portable strength training system of claim 8, the force sensor comprises an application processor and is programmed to transmit information relating to a strength training session selected from the group consisting of: force measured at any moment, force total per the session, time of the session, and combinations thereof.

14. The portable strength training apparatus of claim 1, wherein the force sensor comprises a first hook and a second hook, wherein the first hook is removably coupled to the send end of the resistance band and the second hook is removably coupled to the human interface mechanism.

* * * * *